US009358509B2

(12) United States Patent
Kamiya

(10) Patent No.: US 9,358,509 B2
(45) Date of Patent: Jun. 7, 2016

(54) PARTICLE SIZE BREAKUP APPARATUS HAVING A ROTOR AND A STATOR

(75) Inventor: Tetsu Kamiya, Odawara (JP)

(73) Assignee: MEIJI CO., LTD., Koutou-Ku, Tokyo (JP)

( * ) Notice: Subject to any disclaimer, the term of this patent is extended or adjusted under 35 U.S.C. 154(b) by 539 days.

(21) Appl. No.: 13/817,628

(22) PCT Filed: Aug. 19, 2011

(86) PCT No.: PCT/JP2011/068778
§ 371 (c)(1),
(2), (4) Date: May 1, 2013

(87) PCT Pub. No.: WO2012/023609
PCT Pub. Date: Feb. 23, 2012

(65) Prior Publication Data

US 2013/0215711 A1 Aug. 22, 2013

(30) Foreign Application Priority Data

Aug. 19, 2010 (JP) ..... 2010-184467

(51) Int. Cl.
*B01F 7/16* (2006.01)
*B01F 7/00* (2006.01)
*B01F 5/10* (2006.01)

(52) U.S. Cl.
CPC ..... *B01F 7/00016* (2013.01); *B01F 5/10* (2013.01); *B01F 7/00808* (2013.01);
(Continued)

(58) Field of Classification Search
CPC .... B01F 7/0075; B01F 7/008; B01F 7/00808; B01F 7/00816; B01F 7/00833; B01F 5/104; B01F 7/164; B01F 2215/0404; B01F 2215/0409; B01F 5/165; G01M 13/00
USPC ..... 366/264, 302, 304, 305, 286
See application file for complete search history.

(56) References Cited

U.S. PATENT DOCUMENTS 1,873,199 A * 8/1932 Haskell ..... 241/259.1
1,997,032 A * 4/1935 Alstad et al. ..... 99/453
(Continued)

FOREIGN PATENT DOCUMENTS

JP 8-504663 A 5/1996
JP 10-226981 A 8/1998
(Continued)

OTHER PUBLICATIONS

International Search Report (PCT/ISA/210) issued on Dec. 6, 2011, by the Japanese Patent Office as the International Searching Authority for International Application No. PCT/JP2011/068778.
(Continued)

*Primary Examiner* — Charles Cooley
(74) *Attorney, Agent, or Firm* — Buchanan Ingersoll & Rooney PC

(57) ABSTRACT

A mixer of the rotor-stator type that includes a stator having a plurality of openings and a rotor disposed on the inner side of the stator and spaced by a predetermined gap away from the stator is described, wherein the mixer that is capable of improving the shearing stress applied upon the liquid being processed and provides the higher performance is proposed. The stator includes a plurality of stators each having a different circumferential diameter, and the rotor is disposed on the inner side of the plurality of stators and spaced by the predetermined gap away from the stators so that the stators and the rotor can be brought closer to or farther away from each other in the direction in which the rotary shaft of the rotor extends.

14 Claims, 25 Drawing Sheets

(52) U.S. Cl.
CPC ..... *B01F 7/00833* (2013.01); *B01F 7/164* (2013.01); *B01F 2215/0404* (2013.01); *B01F 2215/0409* (2013.01)

(56) References Cited

U.S. PATENT DOCUMENTS

| | | | | |
|---|---|---|---|---|
| 2,169,339 | A * | 8/1939 | Ditto | 366/305 |
| 2,591,966 | A * | 4/1952 | Rider | 366/286 |
| 3,194,540 | A * | 7/1965 | Hager | 366/305 |
| 3,195,867 | A * | 7/1965 | Mould, Jr. | 366/305 |
| 3,224,689 | A * | 12/1965 | Behrens et al. | 241/244 |
| 3,514,079 | A * | 5/1970 | Little, Jr. | 366/305 |
| 3,658,266 | A * | 4/1972 | O'Keefe et al. | 241/101.2 |
| 3,982,700 | A * | 9/1976 | Love | 241/46.11 |
| 5,088,831 | A * | 2/1992 | Reinhall | 366/171.1 |
| 5,590,961 | A | 1/1997 | Rasmussen | |
| 5,902,042 | A * | 5/1999 | Imaizumi et al. | 366/176.2 |
| 6,000,840 | A * | 12/1999 | Paterson | 366/264 |
| 8,851,741 | B2 * | 10/2014 | Ganmor et al. | 366/171.1 |
| 8,911,141 | B2 * | 12/2014 | Cheio De Oliveira et al. | 366/164.6 |
| 8,960,993 | B2 * | 2/2015 | Cheio De Oliveira et al. | 366/139 |
| 2003/0152500 | A1 * | 8/2003 | Dalziel et al. | 422/245.1 |
| 2004/0187770 | A1 * | 9/2004 | Calabrese et al. | 117/200 |
| 2004/0242764 | A1 | 12/2004 | Yamada et al. | |
| 2005/0242218 | A1 | 11/2005 | Nakano et al. | |
| 2010/0086469 | A1 | 4/2010 | Tennison et al. | |
| 2010/0098615 | A1 | 4/2010 | Tennison et al. | |
| 2011/0026358 | A1 * | 2/2011 | Cheio De Oliveira et al. | 366/139 |
| 2012/0093906 | A1 * | 4/2012 | Ganmor et al. | 424/405 |
| 2013/0215711 | A1 * | 8/2013 | Kamiya | 366/343 |
| 2013/0218348 | A1 * | 8/2013 | Kamiya | 700/275 |
| 2013/0226521 | A1 * | 8/2013 | Kamiya | 702/182 |
| 2013/0315026 | A1 * | 11/2013 | Cheio De Oliveira et al. | 366/134 |
| 2014/0192614 | A1 * | 7/2014 | Kamiya | 366/302 |
| 2015/0306553 | A1 * | 10/2015 | Kamiya | B01F 5/104 426/656 |

FOREIGN PATENT DOCUMENTS

| | | | |
|---|---|---|---|
| JP | 2000-218153 | A | 8/2000 |
| JP | 2004-002732 | A | 1/2004 |
| JP | 2004-008898 | A | 1/2004 |
| JP | 2005-506174 | A | 3/2005 |
| JP | 2010-510947 | A | 4/2010 |
| JP | 2010-511064 | A | 4/2010 |

OTHER PUBLICATIONS

Written Opinion (PCT/ISA/237) issued on Dec. 6, 2011, by the Japanese Patent Office as the International Searching Authority for International Application No. PCT/JP2011/068778.

* cited by examiner

PRIOR ART

External Circulation

PRIOR ART

Internal Circulation

PRIOR ART

PRIOR ART

PRIOR ART

Relationship between Processing (Mixing) Time and Resulting Drop Diameter for Mixers A-1 and A-2

Relationship between Mean Resulting Drop Diameter and Total Energy Dissipation Rate for Mixer A-1 and A-2

○ Lab, $u$ = 27 m/s, $\delta$ = 0.25mm

△ Lab, $u$ = 21 m/s, $\delta$ = 0.25mm

● MP10, $u$ = 25 m/s, $\delta$ = 0.25mm

▲ MP10, $u$ = 20 m/s, $\delta$ = 0.25mm

Relationship between Mean Resulting Drop Diameter and Total Energy Dissipation Rate for Mixer B Effect of Gap on Particle Size Breakup Effect Effect of Hole Diameter of Opening Portion on Particle Size Breakup Effect Effect of Number of Holes (Opening Area Ratio) on Particle Size Breakup Effect Performance Improvement Effect of Existing Relationship between Mixing Time and Drop Diameter under Running Condition for Mixer C in Table 8

Relationship between Average Liquid Drop Diameter and Total Energy Dissipation Rate for Mixer C (Stators No. 1 to No.5)

Relationship between Mean Drop Diameter and Total Energy Dissipation Rate for Mixers D and E Relationship between Mixing Time and average Liquid Drop Diameter (a)

Relationship between Number of Rotations and Flow Rate (b)

Relationship between Number of Rotations and Drive Power (c)

Relationship between Number of Rotations and Emulsify Contribution Power

PARTICLE SIZE BREAKUP APPARATUS HAVING A ROTOR AND A STATOR

BACKGROUND

1. Technical Field

The present invention relates to the mixers of the so-called rotor-stator type, and more specifically to the mixer that includes a stator having a plurality of openings (holes) and a rotor that is disposed on the inner side of the stator and spaced by a particular gap away from the stator.

2. Description of the Prior Art

As shown in FIG. 1, it is general that the mixer of the so-called rotor-stator type comprises a mixer unit 4 that includes a stator 2 having a plurality of openings (holes) 1 and a rotor 3 disposed on the inner side of the stator 2 and spaced by a particular gap δ from the stator 2. Such mixer of the rotor-stator type is provided for subjecting a fluid or fluid or liquid being processed to the emulsification, dispersion, particle size breakup, mixing or any other similar process, by taking advantage of the fact that a high shear stress may be produced in the neighborhood of the gap between the stator 3 capable of rotating at high-speeds and the stator 2 being fixed in position. This mixer is used for mixing or preparing the fluid or fluid or liquid being processed, and has a wide variety of applications in which the foods, pharmaceutical medicines, chemical products and the like can be manufactured.

The mixers of the rotor-stator type may be classed according to the type of the circulation mode for the fluid or liquid being processed, that is, one type being the externally circulated mixer in which the fluid or liquid being processed may be circulated in the direction indicated by the arrow 5*a* in FIG. 2, and the other type being the internally circulated mixer in which the fluid or liquid being processed may be circulated in the direction indicated by the arrow 5*b* in FIG. 2.

For the mixer of the rotor-stator type, many different configurations and circulation modes or systems have been proposed. For example, the Japanese patent application No. 2006-506174, which describes the rotor and stator apparatus and method for forming the particle sizes, proposes the particle size breakup apparatus and method for forming those particle sizes in which the mixer that includes the stator having a plurality of openings (holes) and the rotor disposed on the inner side of the stator and spaced by a particular gap away from the stator can be used widely in the manufacturing fields, such as the pharmaceutical medicines, nutrition supplement foods, other foods, chemical products, cosmetics and the like. Using the apparatus and method described above, the mixers can be scaled up in the efficient, simple and easy manners.

In addition, for those past years, several indices (theories) have been reported as the performance estimation method for the mixers having the different configurations.

When the liquid-to-liquid operation is considered not only for the mixer of the rotor-stator type as described above but also for all other type mixers, for example, there are several reports in which the resulting drop diameter sizes can be discussed in terms of the magnitude (smallness or greatness) of the values that can be obtained by calculating the average energy dissipation rate (publications 1 and 2). In those publications 1 and 2, however, the method for calculating the average energy dissipation rates is not disclosed specifically.

The publications 3 to 6 report several study cases that may be applied to each individual mixer and in which the results obtained by the respective experiments have been arranged or organized systematically into the graphical chart. In those study cases (Publications 3 to 6), however, it is considered that the mixer's particle size breakup effect is only affected by the gap between the rotor and stator and by the openings (holes) on the stator. It is only described that this information differs for each different type mixer.

Several study cases are also reported (Publications 7 and 8), in which the particle size breakup mechanism for the mixer of the rotor-stator type was considered and discussed. In those publications 7 and 8, it is suggested that the energy dissipation rate of the turbulent flow will contribute to the particle size breakup effect, and the particle size breakup effect may be affected by the frequency (shear frequency) of the turbulent flow with which the particle size breakup effect is placed under the shear stress of the fluid or liquid being processed.

For the scale-up method for the mixer of the rotor-stator type, there are several reports (Publication 9) in which the final resulting drop diameter (maximum stable diameter) can be obtained during the long-time mixer running period. This, however, is not practical in the actual production sites and is of no utility. Specifically, there are no reports regarding the study cases in which the processing (agitation and mixing) time of the mixer is the object for consideration, and those study cases are not useful enough to estimate the resulting drop diameters that can be obtained during the particular mixer running period. Although it is reported that the resulting drop diameters may be estimated by considering the mixer processing time, yet it is only reported that the phenomenon (factual action) is based on the actual measured values (experimental values). In those study cases, such phenomenon is not analyzed theoretically.

In the patent application cited above, the superiority (performance) of the particular mixer and the value range of the design on which the mixer is based are disclosed, but the theoretical grounds on which the value range of the high-performance mixer design is based are not described. The types and configurations of the high performance mixers are not described specifically.

It may be appreciated from the above description that, for those past years, several indices (theories) have been reported as the performance estimation method for the mixers having the different configurations. In most cases, however, those indices can only be applied to each of the individual mixers having the same configuration. In the actual cases, however, they cannot be applied to the mixers of the various types having the different configurations. Although there are the indices that can only be applied to those mixers in which the gap between the rotor and stator will largely affect the particle size breakup effect or there are the indices that can only be applied to those mixers in which the opening portion (hole) of the stator will affect the particle size breakup effect. The indices that can be applied to those mixers that have all possible configurations are not discussed specifically. That is, there are no indices that can be applied to the mixers having all possible configurations.

As noted above, there are almost no study cases in which the performance estimation method and scale-up method for those mixers of the rotor-stator type have been defined. There are also no study cases in which those methods can be applied to the mixers of the various types having the different configurations, and the data on the results obtained by the experiments on such study cases have not been arranged or organized systematically into the graphical chart.

For the performance estimation method and scale-up method for the mixers of the rotor-stator type according to the prior art, in most cases, the final resulting drop diameters (maximum stable drop diameters) were obtained by using the small scale device for each individual mixer and permitting the device to run for the long time period, and were then estimated. More specifically, in the prior art, there is no estimation method that can be used to estimate the resulting drop diameters that would be obtained by using the large-scale devices (actual production installation) for the mixers of the various types and permitting such large-scale devices to run during the particular time period, or there is no estimation method that can be used to estimate the particular resulting drop diameters obtained during the particular running time or the processing or agitating time required until such particular resulting drop diameters can be obtained.

Although there are indices that can only be applied to the mixer in which the size of the gap between the rotor and stator may largely affect the particle size breakup effect or emulsification effec or although there are the indices that can only be applied to the mixer in which the size or configuration of the opening (hole) of the stator may largely affect the particle size breakup effect or emulsification effect. For example, there are no comprehensive indices that can be applied to the mixers having the various configurations (the theories on which the various types of mixers can be compared or estimated comprehensively) were not discussed, and there are no indices that take the above discussion into consideration.

The performance of the mixer was actually estimated on the error and trial basis using the actual fluid or liquid being processed, therefore, and the mixers ware then designed, developed and fabricated accordingly.

The following publication, which is the document related to the patent application, is cited herein for reference:

Japanese Patent Application No. 2005-506174

The following publications, which are not related to the patent application, are cited herein for reference:

(1) David, J. T.; "Drop Sizes of Emulsions Related to Turbulent Energy Dissipation Rates", Chem. Eng. Sci., 40, 839-842 (1985) and David J. T.; "A Physical Interpretation of Drop Sizes in Homogenizers;

(2) Davies, J. T.; "A Physical Interpretation of Drop Sizes in Homogenizers and Agitated Tanks, Including the Dispersion of Viscous Oils", Chem. Eng. Sci., 42, 1671-1676 (1987);

(3) Calabrese, R. V., M. K. Francis, V. P. Mishra and S. Phongikaroon; "Measurement and Analysis of Drop Size in Batch Rotor-Stator Mixer", Proc. 10th European Conference on Mixing, pp. 149-156, Delft, the Netherlands (2000);

(4) Calabrese, R. V., M. K. Francis, V. P. Mishra, G. A. Padron and S. Phongikaroon; "Fluid Dynamic and Emulsification in High Shear Mixers", Proc. 3rd World Congress on Emulsion, pp. 1-10, Lyon, France (2002);

(5) Maa, Y. F., and C. Hsu, and C. Hsu; "Liquid-Liquid Emulsification by Rotor/Stator Homogenization", J. Controlled. Release, 38, 219-228 (1996); (6) Barailler, F., M. Heniche and P. A. Tanguy; "CFD Analysis of a Rotor-Stator Mixer with Viscous Fluids", Chem. Eng. Sci., 61, 2888-2894 (2006);

(7) Utomo, A. T., M. Baker and A. W. Pacek; "Flow Pattern, Periodicity and Energy Dissipation in a Batch Rotor-Stator Mixer", Chem. Eng. Res. Des., 86, 1397-1409 (2008);

(8) Porcelli, J.; "The Science of Rotor-Stator Mixers", Food Process, 63, 60-66 (2002);

(9) Urban, K.: "Rotor-Stator and Disc System for Emulsification Processes", Chem. Eng. Technol., 29, 24-31 (2006)

SUMMARY OF THE INVENTION

One object of the present invention is to provide a mixer of the rotor-stator type that includes a stator having a plurality of openings and rotor that is located on the inner side of said stator and spaced away from said stator by a predetermined gap, wherein the present invention proposes to provide the mixer of the above type that can provide the higher performance by improving the shear stress applied to the liquid being processed and by allowing the shear stress applied to the liquid being processed to be changed and adjusted accordingly or by allowing the flow rate of the liquid being processed to be changed and adjusted accordingly.

Another object of the present invention is to provide a comprehensive performance estimation method that can be applied to mixers having many different configurations and liquid circulation modes, wherein such higher performance mixer of the rotor-stator type can be designed by utilizing the comprehensive performance estimation method and the design method that considers the running condition (processing time) of the particular mixer.

Still another object of the present invention is to provide a manufacturing method (particle size breakup method) whereby foods, pharmaceutical medicines, chemical products and the like can be produced by using the higher performance mixer of the rotor-stator type that can be designed and provided by utilizing the performance estimation method and the design method.

In a first aspect of the invention, A mixer of the rotor-stator type comprising a mixer unit that includes a stator having a plurality of openings and a rotor disposed on the inner side of the stator and spaced by a predetermined gap away from the stator, wherein said stator includes a plurality of stators each having a different peripheral diameter and said rotor is disposed in such a manner that it is spaced by the predetermined gap away from said plurality of stators; and said stators and said rotor are arranged so that they can be brought closer to or farther away from each other in the direction in which the rotary shaft of said rotor extends.

In a second aspect of the invention, The mixer, wherein the liquid being processed is introduced into the gap portion between said stators and said rotor which is located on the inner side of each of said stators and is spaced by the predetermined gap away from each of said stators.

In a third aspect of the invention, The mixer, wherein said stators have an annular cover that extends inwardly from the upper end edge thereof.

In a fourth aspect of the invention, The mixer, wherein said annular cover that is located on the radial inner side of the stator that has the smallest diameter among said plurality of stators has an inlet hole through which a fluid being processed is introduced downwardly.

In a fifth aspect of the invention, The mixer, being characterized by the fact that the opening provided on each of said stators has a round shape.

In a sixth aspect of the invention, The mixer, wherein the openings on said plurality of stators are provided around the peripheral wall of each of said stators, and represent more than 20% of the total opening area.

In a seventh aspect of the invention, The mixer, wherein said rotor has a plurality of agitating blades extending radially from its center of rotation.

In a eighth aspect of the invention, A mixer having the construction of the mixer, wherein the mixer is so designed by using the Equation 1 below to estimate the running time of said mixer and the resulting liquid drop diameters of the fluid being processed that can be obtained during the mixer's running time that the liquid drop diameters of the fluid being processed can be obtained during the particular mixer running time when said mixer is used to subject the fluid being processed to the emulsification, dispersion, particle size breakup or any other mixing processing:

$$\begin{aligned}\varepsilon_a &= \varepsilon_g + \varepsilon_s \\ &= [(N_p - N_{qd}\pi^2)\cdot n_r] \\ &\quad \left\{D^3\left[\left(\frac{D^3 b}{\delta(D+\delta)}\right) + \frac{\pi^2 n_s^2 d^3 (d+4\ell)}{4N_{qd}[n_s\cdot d^2 + 4\delta(D+\delta)]}\right]\right\}\left(\frac{N^4\cdot t_m}{V}\right) \\ &= [(N_p - N_{qd}\pi^2)\cdot n_r]\cdot[D^3(K_g+K_s)]\cdot\left(\frac{N^4\cdot t_m}{V}\right) \\ &= K_c\cdot\left(\frac{N^4\cdot t_m}{V}\right)\end{aligned} \quad \text{Equation 1}$$

In the Equation 1, $\epsilon_a$: Total energy dissipation rate ($m^2/s^3$)

$\epsilon_g$: Local shear stress in the gap between the rotor and stator ($m^2/s^3$)

$\epsilon_s$: Local energy dissipation rate in the stator ($m^2/s^3$)

$N_p$: Number of powers (-)

Nqd: Number of flow rates (-)

$n_r$: Number of rotor blades (-)

D: Diameter of rotor (m)

b: Thickness of rotor blade tip (m)

δ: Gap between rotor and stator (m)

$n_s$: Number of stator holes (-)

d: Diameter of stator hole (m)

l: Thickness of stator (m)

N: Number of rotations (I/s)

$t_m$: Mixing time (s)

V: Flow rate ($m^3$)

$K_g$: Configuration dependent term ($m^2$)

$K_s$ Configuration dependent term in stator ($m^2$)

$K_c$: Configuration dependent term for the entire mixer

In a ninth aspect of the invention, The mixer, wherein the mixer can be scaled up or scaled down by calculating the Equation 1 below to estimate the particular mixer running time and the resulting liquid drop diameters for the fluid being processed thus obtained during the particular mixer running time:

$$\begin{aligned}\varepsilon_a &= \varepsilon_g + \varepsilon_s \\ &= [(N_p - N_{qd}\pi^2)\cdot n_r] \\ &\quad \left\{D^3\left[\left(\frac{D^3 b}{\delta(D+\delta)}\right) + \frac{\pi^2 n_s^2 d^3 (d+4\ell)}{4N_{qd}[n_s\cdot d^2 + 4\delta(D+\delta)]}\right]\right\}\left(\frac{N^4\cdot t_m}{V}\right) \\ &= [(N_p - N_{qd}\pi^2)\cdot n_r]\cdot[D^3(K_g+K_s)]\cdot\left(\frac{N^4\cdot t_m}{V}\right) \\ &= K_c\cdot\left(\frac{N^4\cdot t_m}{V}\right)\end{aligned} \quad \text{Equation 1}$$

In the Equation 1, $\epsilon_a$: Total energy dissipation rate ($m^2/s^3$)

$\epsilon_g$: Local shear stress in the gap between the rotor and stator ($m^2/s^3$)

$\epsilon_s$: Local energy dissipation rate in the stator ($m^2/s^3$)

$N_p$: Number of powers (-)

Nqd: Number of flow rates (-)

$n_r$: Number of rotor blades (-)

D: Diameter of rotor (m)

b: Thickness of rotor blade tip (m)

δ: Gap between rotor and stator (m)

$n_s$: Number of stator holes (-)

d: Diameter of stator hole (m)

l: Thickness of stator (m)

N: Number of rotations (I/s)

$t_m$: Mixing time (s)

V: Flow rate ($m^3$)

$K_g$: Configuration dependent term ($m^2$)

$K_s$ Configuration dependent term in stator ($m^2$)

$K_c$: Configuration dependent term for the entire mixer

In a ninth aspect of the invention, A method for manufacturing the foods, pharmaceutical medicines or chemical products by using the mixer to subject the fluid being processed to the emulsification, dispersion, particle size breakup or mixing processing, being characterized by the fact that the foods, pharmaceutical medicines or chemical products are manufactured by using the Equation 1 below to estimate the particular mixer running time and the resulting drop diameters for the fluid being processed thus obtained during the particular mixer running time:

$$\begin{aligned}\varepsilon_a &= \varepsilon_g + \varepsilon_s \\ &= [(N_p - N_{qd}\pi^2)\cdot n_r] \\ &\quad \left\{D^3\left[\left(\frac{D^3 b}{\delta(D+\delta)}\right) + \frac{\pi^2 n_s^2 d^3 (d+4\ell)}{4N_{qd}[n_s\cdot d^2 + 4\delta(D+\delta)]}\right]\right\}\left(\frac{N^4\cdot t_m}{V}\right) \\ &= [(N_p - N_{qd}\pi^2)\cdot n_r]\cdot[D^3(K_g+K_s)]\cdot\left(\frac{N^4\cdot t_m}{V}\right) \\ &= K_c\cdot\left(\frac{N^4\cdot t_m}{V}\right)\end{aligned} \quad \text{Equation 1}$$

In the Equation 1, $\epsilon_a$: Total energy dissipation rate ($m^2/s^3$)

$\epsilon_g$: Local shear stress in the gap between the rotor and stator ($m^2/s^3$)

$\epsilon_s$: Local energy dissipation rate in the stator ($m^2/s^3$)

$N_p$: Number of powers (-)

Nqd: Number of flow rates (-)

$n_r$: Number of rotor blades (-)

D: Diameter of rotor (m)

b: Thickness of rotor blade tip (m)

δ: Gap between rotor and stator (m)

$n_s$: Number of stator holes (-)

d: Diameter of stator hole (m)

l: Thickness of stator (m)

N: Number of rotations (I/s)

$t_m$: Mixing time (s)

V: Flow rate ($m^3$)

$K_g$: Configuration dependent term ($m^2$)

$K_s$ Configuration dependent term in stator ($m^2$)

$K_c$: Configuration dependent term for the entire mixer

In a eleventh aspect of the invention, Foods, pharmaceutical medicines or chemical products are manufactured by using the method defined above.

As one of the advantages, the present invention provides the mixer of the rotor-stator type that includes the stator having the plurality of openings and the rotor that is located on the inner side of the stator and spaced away from the stator by the predetermined gap, wherein the shear stress applied to the liquid being processed is improved so that the mixer can provide the higher performance, and the shear stress applied to the liquid being processed can be changed and adjusted accordingly or the flow rate of the liquid being processed can also be changed and adjusted accordingly.

As another advantage, the present invention provides the comprehensive performance estimation method that can be applied to any one of the various mixers having many different configurations and liquid circulation modes, wherein the mixer of the rotor-stator type that provides the higher performance can be designed by utilizing the comprehensive performance estimation method and the design method that considers the running condition (processing time) of the particular mixer.

As a further advantage, the present invention provides the manufacturing method (particle size breakup method) whereby foods, pharmaceutical medicines, chemical products and the like can be produced by using the higher performance mixer of the rotor-stator type that can be designed and provided by utilizing the performance method and the design method.

In the present invention, the index that may be referred to as the total energy dissipation rate $\epsilon_a$ is applied. The total energy dissipation rate $\epsilon_a$ for the mixers of the various types which are offered by each of the mixer's companies and each of which has the many different configurations and is capable of running in the particular circulation mode may be calculated individually from the values measured on the geometrical sizes and running powers and flow rates for the rotor and stator in each individual mixer. Then, the total energy dissipation rate $\epsilon_a$ may be expressed separately from the configuration dependent term and running condition depending term for each of those mixers.

By using the index that may referred to as the total energy dissipation rate $\epsilon_a$, the values (magnitude) measured on the configuration depending terms can be used when the performance for each of the mixers is estimated or when the performance is estimated by the particle size breakup trend for the resulting drop diameters, for example.

When each individual mixer is to be scaled up or scaled down, the total energy dissipation rat $\epsilon_a$ may be calculated as coupled with the configuration dependent term and running condition dependent term. Thus, the mixer may be designed by using those calculated values so that the total energy dissipation rate $\epsilon_a$ can agree with those calculated values.

Based upon the above discoveries described above, it is found that the mixer that provides the higher particle size breakup effect and emulsification effect than the conventional mixers both theoretically and experimentally (the high performance mixers) can be designed, developed and manufactured.

According to the present invention, the value range for the high performance mixer can be specified in terms of the values measured on the configuration dependent terms (factors) that may be applied to the performance estimation method for each individual mixer. More specifically, the value range that was not covered by the conventional mixers can now be specified in terms of the values for the configuration dependent term (factor) by using the index called as the total energy dissipation rate $\epsilon_a$, or the value range that could not be calculated easily by using the conventional index (theory) or would be difficult to be calculated unless it is measured actually can now be specified in terms of the values for the configuration term (factor) by using the index called as the total energy dissipation rate $\epsilon_a$.

According to the method for manufacturing the foods, pharmaceutical medicines, chemical products or the like by subjecting the fluid or liquid being processed to the emulsification, dispersion, particle size breakup, mixing or any other similar process that occurs by using the mixer of the rotor-stator type, the particular mixer running time and the resulting drop diameters thus obtained during the particular running time can be estimated by the total energy dissipation rate $\epsilon_a$, and the foods (such as the dairy goods, beverage, etc.), pharmaceutical medicines (such as the non-medical goods, etc.), chemical products (such as the cosmetic articles, etc.) or the like having the desired resulting drop diameters can thus be manufactured.

Note, however, that when the nutritious compositions (which are equivalent to the compositions of the liquid foods, the powdered milks conditioned for babies and the like) are manufactured by using the present invention, they will have the good flavors, tastes, physical properties, qualities, etc., and the present invention can be performed in the hygienic or workable environment. Preferably, the present invention can be applied to the manufacture of the foods or pharmaceutical medicines. More preferably, the present invention can be applied to the manufacture of the foods in particular. Much more preferably, the present invention can be applied to the manufacture of the nutritious compositions or dairy milks. Most preferably, the present invention can be applied to the manufacture of the nutritious compositions or dairy milks that contain the highly concentrated composition.

BEST MODE OF EMBODYING THE INVENTION

Figure 1:
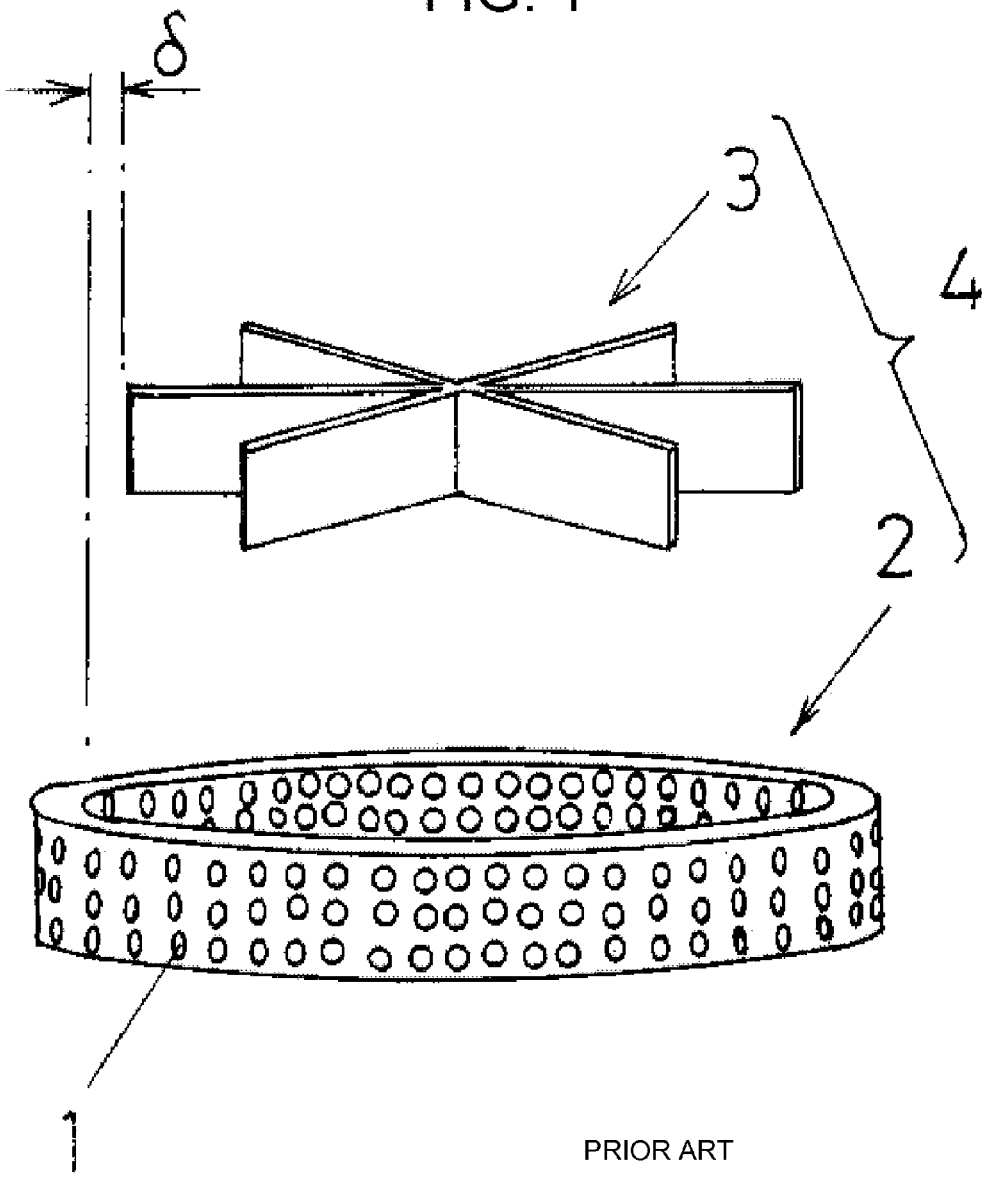
FIG. 1 is a perspective view illustrating the mixer unit which is included in the mixer of the rotor-stator type.
Figure 2:
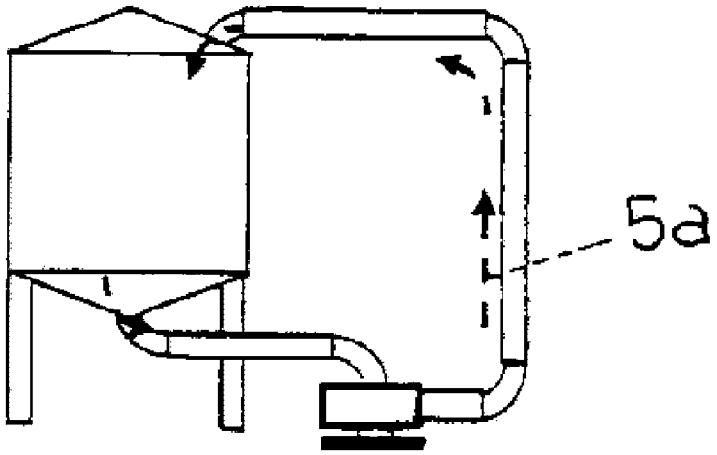
FIG. 2 is a diagram illustrating the mixer of the rotor-stator type that runs in the external circulation mode (externally circulated mixer) and the mixer of the rotor-stator type that runs in the internal circulation mode (internally circulated mixer)
Figure 2:
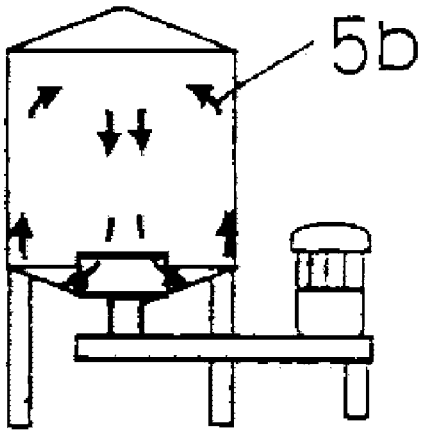

According to the present invention, the total energy dissipation rate $\epsilon_a$ which can be derived from the Equation 1 given below is used to discuss (compare and estimate) the particle size breakup effect (particle size breakup trend) for the mixer of the rotor-stator type:

$$\begin{aligned}\varepsilon_a &= \varepsilon_g + \varepsilon_s \\ &= [(N_p - N_{qd}\pi^2)\cdot n_r] \\ &\quad \left\{D^3\left[\left(\frac{D^3 b}{\delta(D+\delta)}\right) + \frac{\pi^2 n_s^2 d^3 (d+4\ell)}{4N_{qd}[n_s\cdot d^2 + 4\delta(D+\delta)]}\right]\right\}\left(\frac{N^4\cdot t_m}{V}\right) \\ &= [(N_p - N_{qd}\pi^2)\cdot n_r]\cdot[D^3(K_g+K_s)]\cdot\left(\frac{N^4\cdot t_m}{V}\right) \\ &= K_c\cdot\left(\frac{N^4\cdot t_m}{V}\right)\end{aligned} \qquad \text{Equation 1}$$

In the Equation 1, $\epsilon_a$: Total energy dissipation rate ($m^2/s^3$)

$\epsilon_g$: Local shear stress in the gap between the rotor and stator ($m^2/s^3$)

$\epsilon_s$: Local energy dissipation rate in the stator ($m^2/s^3$)

$N_p$: Number of powers (-)

Nqd: Number of flow rates (-)

$n_r$: Number of rotor blades (-)

D: Diameter of rotor (m)

b: Thickness of rotor blade tip (m)

δ: Gap between rotor and stator (m)

$n_s$: Number of stator holes (-)

d: Diameter of stator hole (m)

l: Thickness of stator (m)

N: Number of rotations (l/s)

$t_m$: Mixing time (s)

V: Flow rate ($m^3$)

$K_g$: Configuration dependent term ($m^2$)

$K_s$ Configuration dependent term in stator ($m^2$)

$K_c$: Configuration dependent term for the entire mixer

Using the total energy dissipation rate $\epsilon_a$ described above, the particle size breakup effect (particle size breakup trend) for the mixer of the rotor-stator type can be discussed (compared or estimated) in the comprehensive and consistent manner, although there may be differences in the mixer configuration, stator configuration, mixer running condition (processing time such as the mixing time), scale (size) and the like.

As described above, the total energy dissipation rate $\epsilon_a$ may be expressed in terms of the total (sum) of the local shear stress $\epsilon_g$ in the gap between the rotor and stator and local energy dissipation rate $\epsilon_s$ for the stator.

According to the present invention, the mixer performance is estimated by estimating the magnitude of the values for the configuration dependent term $K_c$ of the entire mixer which are specific to each mixer and can be obtained by measuring the sizes of the rotor and stator and mixer running powers and flow rates, which are components of the Equation 1 from which the total energy dissipation rate $\epsilon_a$ can be derived.

As it is clear from the Equation 1 of the present invention for deriving the total energy dissipation rate $\epsilon_a$, the configuration depending term $K_g$ ($m^2$) is the value that is specific to each mixer and is based on the gap δ (m) between the rotor and stator, the diameter D (m) of the rotor, and the thickness b (m) of the blade tip of the rotor.

In addition, the configuration depending term $K_s$ ($m^2$) for the rotor is the value that is specific to each mixer, and is based on the number of flow rates $N_{qd}$ (-), the number of stator holes $n_s$, the hole diameter of the stator d(m), the thickness of the stator 1 (m), the gap between the rotor and stator δ (m) and the diameter of the rotor D (m).

The configuration dependent term $K_c$ ($m^5$) for the entire mixer is the value that is specific to each mixer and is based on the number of powers $N_p$ (-), the number of flow rates $N_{qd}$ (-), the number of rotor blades $n_r$ (-), the diameter of the rotor D (m) and the configuration depending term $K_g$ ($m^2$) for the stator.

Note that the number of powers: NP[-] and the number of flow rates: $N_{qd}$ [-] are the dimensionless quantities that are generally used in the chemical engineering field and are defined as follows.

$Q=N_{qd}\cdot N\cdot D^3$ ($Q$: flow rate, $N$: number of rotations, $D$: mixer diameter)

$P=N_p\cdot\rho\cdot N^3\cdot D^5$ ($\rho$: density, $N$: number of rotations, $D$: mixer diameter)

Namely, the number of flow rates and the number of powers are the dimensionless quantities that can be derived from the flow rates and powers measured on the experimental basis.

Specifically, the configuration depending term $K_c$ for the entire mixer is the value that is specific to each mixer and can be obtained by measuring the sizes of the rotor and stator and the power and flow rate during the mixer running time.

By comparing (estimating) the magnitude of those values, then, the performances of the various mixers can be estimated, and the high performance mixer can also be designed (developed and fabricated).

According to the present invention, the mixer can be designed, based upon the Equation 1 that may be used to derive the total energy dissipation rate $\epsilon_a$ as described above.

<Change in the Total Energy Dissipation Rate $\epsilon_a$ Versus the Resulting Change (Particle Size Breakup Trend for the Resulting Drop Diameter) in the Resulting Drop Diameter>

Assuming that a dairy product is used to estimate its particle size breakup trend, a liquid that simulates the dairy product has been provided. The liquid that is provided to simulate the dairy product contains the milk protein concentration (MPC, TMP (total milk protein)), rapeseed oil and water. Its composition and ratio are presented in Table 1.

TABLE 1

Composition Ratio of Simulated Liquid for Milk Product

| | | |
|---|---|---|
| Composition | Milk Product Concentrate (MPC) | 8.0% |
| | Rape Seed Oil | 4.5% |
| | Water | 87.5% |
| | Total | 100% |
| Ratio | Protein/Water | 9.1% |
| | Oil/Protein | 56.3% |
| | Oil/Water | 5.1% |

TABLE 1-continued

Composition Ratio of Simulated Liquid for Milk Product

| | | |
|---|---|---|
| Properties | Density | 1028 $kg/m^3$ |
| | Viscosity | 15 mPa · s |

Figure 3:
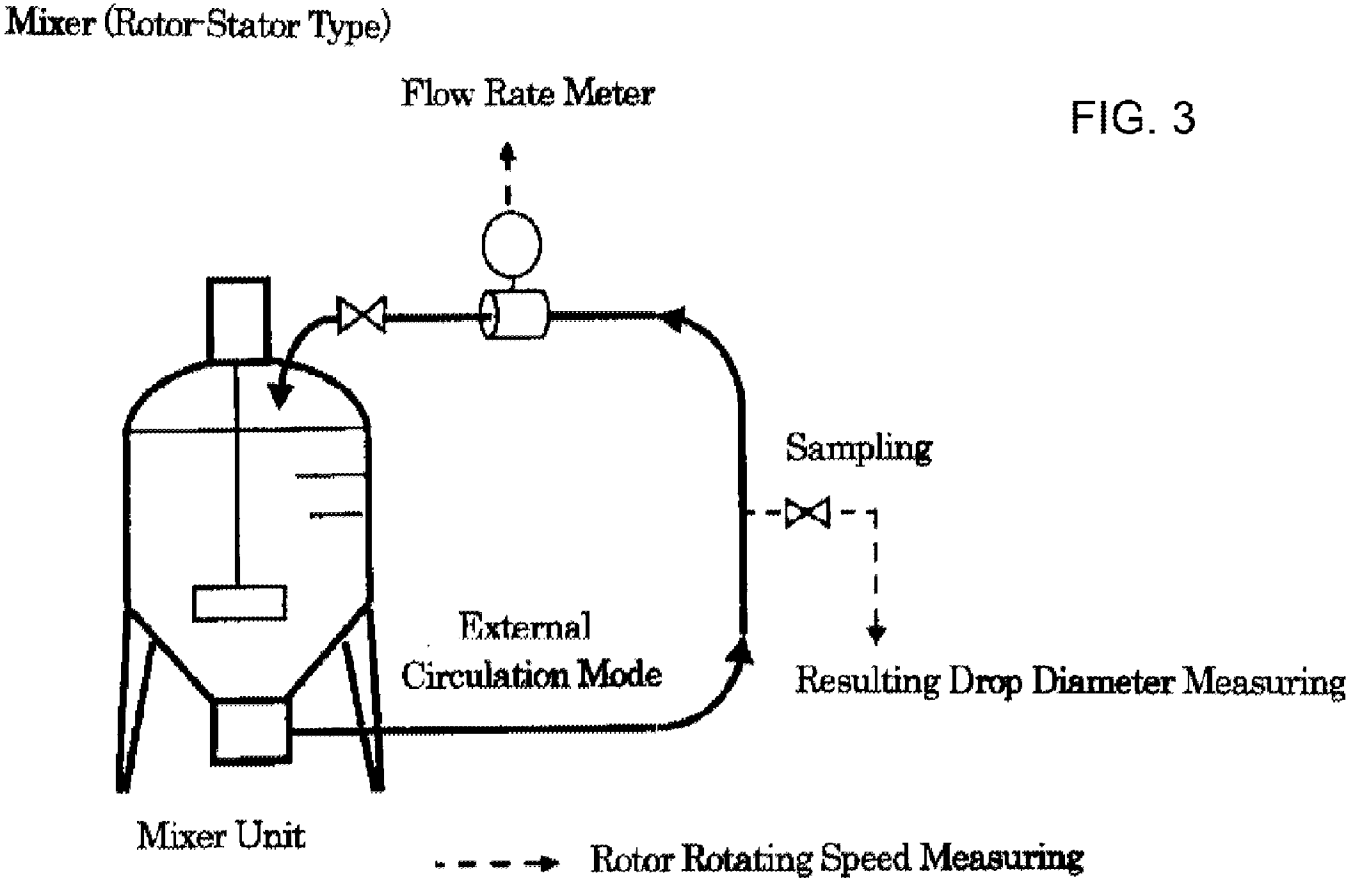
FIG. 3 illustrates the system in which the particle size breakup trend for the resulting drop diameters can be investigated.

The mixer performance was estimated by checking the particle size breakup trend for the resulting drop diameters on the experimental basis. The unit that employs the external circulation system as shown in FIG. 3 was provided, and the resulting drop diameters was measured on the middle way of the liquid path by using the laser diffraction-type particle size analyzer (SALD-2000 as offered by Shimazu Manufacturing Company).

Figure 4:
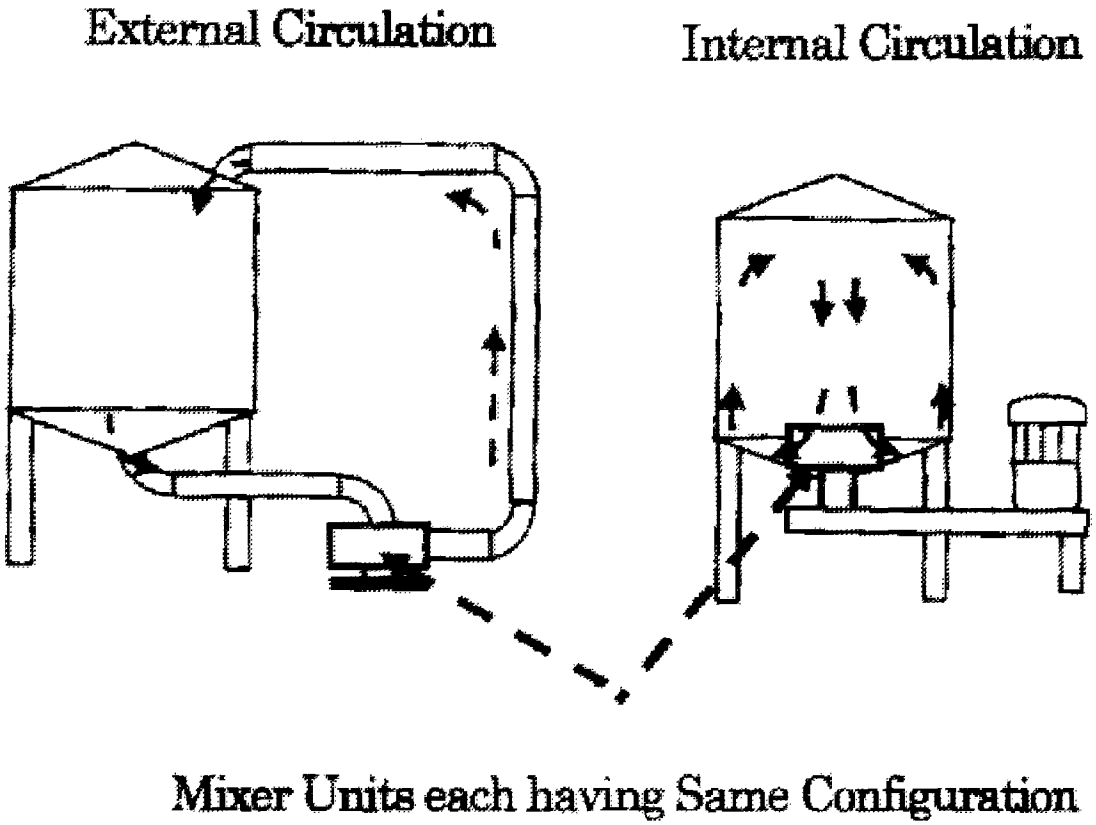
FIG. 4 illustrates the system in which the experimental results on the mixer of the rotor-stator type that runs in the external circulation mode (the externally circulated mixer) may be used to estimate the performance of the mixer of the rotor-stator-type that runs in the internal circulation mode (internal circulated mixer)

In the present invention, however, it is found that as far as the internally circulated mixer in particular is concerned, it is difficult to grasp the particle size breakup trend for the resulting drop diameters when the particle size breakup trend for the resulting drop diameters is examined on the experimental basis and the mixer performance is then estimated. For the internally circulated mixer, however, they are common in that either of those mixers comprises the mixer unit 4 which includes the stator 2 having the plurality of openings (holes) 1 and the stator which is disposed on the inner side of the status 2 and spaced by the particular gap δ away from the stator 2, as shown in FIG. 1. When the performance of the internally circulated mixer was then to be estimated, this was done by using the results obtained by estimating the externally circulated mixer, under the assumption that the internally circulated mixer comprises the same mixer unit as the externally circulated mixer which included the rotor and stator each having the same dimension (size), configuration and structure as the externally circulated mixer as shown in FIG. 4.

Then, the respective performances of those three mixers were compared. The specifications of those mixers which were used for the purpose of this comparison are given in Table 2.

TABLE 2

Summary of Mixer

| | | | Mixer A-1 1.5 L | Mixer A-2 1.5 L | Mixer B 9 L |
|---|---|---|---|---|---|
| | | | Stator No. | | |
| | | | 6 | 6 | 7 |
| Rotor Diameter | [mm] | D | 30 | 30 | 57 |
| Maximum Number of Rotations | [rpm] | $N_{max}$ | 26000 | 26000 | 8400 |
| Maximum Motor Driving Power | [kW] | $P_{g,max}$ | 0.9 | 0.9 | 1.5 |
| Number of Openings | [—] | $n_a$ | 3 | 6 | 5 |
| Size of Gap | [mm] | δ | 0.15 | 0.25 | 0.25 |
| Volume of Gap | [$m^3$] | $v_g$ | $3.56\times10^{-8}$ | $5.96\times10^{-8}$ | $2.70\times10^{-7}$ |

Number of Rotor's Blades $n_r$: 4

The mixers A-1 and A-2 are offered from the same manufacturer, and have the same capacity of 1.5 although they have the different sizes.

In Table 2, the gap volume $v_g$ corresponds to the volume of the part of the gap δ in FIG. 1.

The number of the agitating blades for the rotor 3 that is included in each of the mixers A-1 and A-2 (each having the capacity of 1.5 liters and B (having the capacity of 9 liters) is four for the mixer A-1, four for the mixer A-2 and four for the mixer B.

The experimental conditions and the calculated values of the total energy dissipation rate $\epsilon_a$ are given in Table 3.

TABLE 3

Experimental Conditions and Calculated Values

| | | | Stator No. | | |
|---|---|---|---|---|---|
| | | | Mixer A-1 | Mixer A-2 | Mixer B |
| Speed of Rotation | N | [rpm] | 17000<br>13600<br>8400 | 17000<br>13600<br>8400 | 8400<br>6720 |
| Speed of Rotor's Tip | u | [m/s] | 26.8<br>21.4<br>13.2 | 26.6<br>21.3<br>13.2 | 25.1<br>20.0 |
| Ratio of Configuration Dependent Term | $K_g/(K_g+K_g)$ | [—] | 0.86<br>0.87<br>0.87 | 0.81<br>0.79<br>0.83 | 0.94<br>0.94 |
| Total Energy Dissipation Rate | $\epsilon_a$ | [$m^2/s^3$] | $14.8 \times 10^5$<br>$4.81 \times 10^5$<br>$0.92 \times 10^5$ | $9.03 \times 10^5$<br>$2.07 \times 10^5$<br>$0.34 \times 10^5$ | $7.62 \times 10^5$<br>$1.25 \times 10^5$ |

In Table 3, since the value of $K_g/(K_g+K_s)$ is equal to more than 0.5, $K_g$ that is the configuration dependent term for the gap is greater than the configuration dependent term $K_s$ for the stator. When the particle size breakup effects for the gap and opening (hole) portion 1 in the stator 2 are then compared, it is found that the particle size breakup effect for the mixer gap δ is greater and dominating.

From the values of the total energy dissipation rate $\epsilon_a$ presented in Table 3, it was estimated that the particle size breakup effect would become higher as the gap δ in the mixer is narrower and as the number of rotations for the stator is greater.

Figure 5:
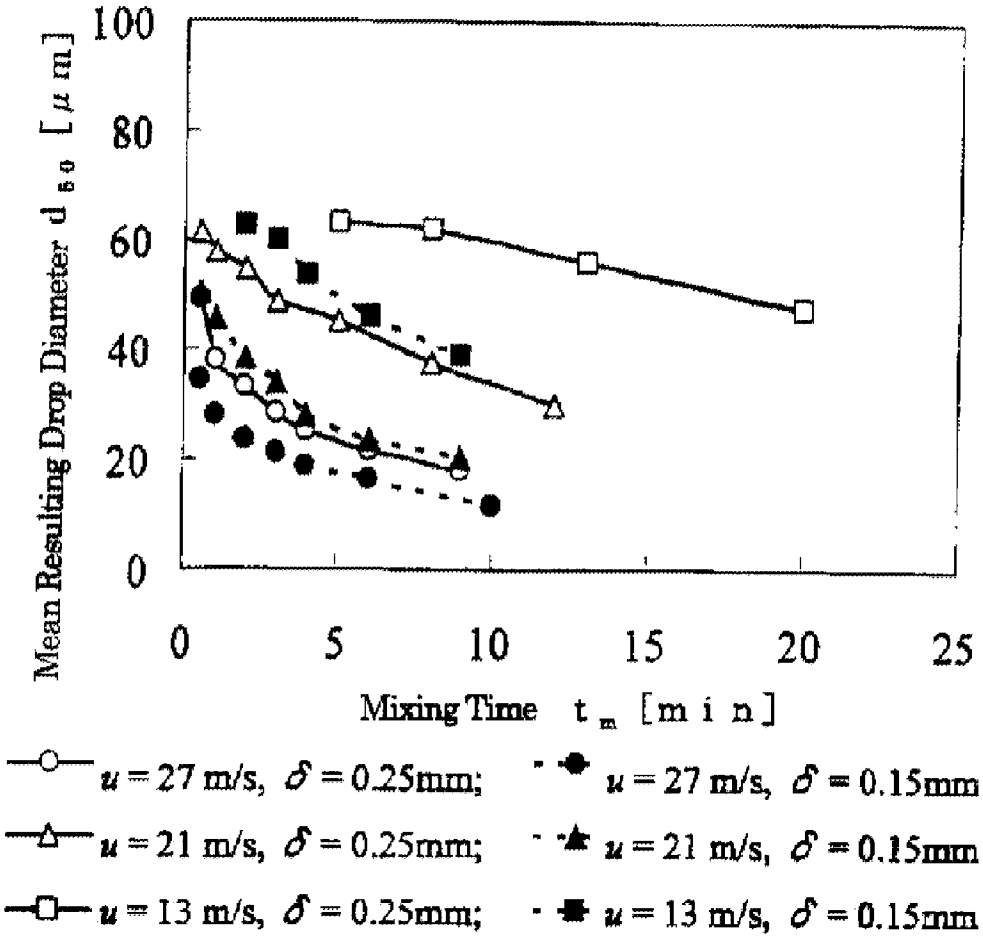
FIG. 5 represents the relationship (particle size breakup trend) between the processing (mixing) time and the resulting drop diameters for the mixer of the rotor-stator type.

For the mixer A-1 and mixer A-2 in Table 2, the relationship (the particle size breakup trend) between the processing (mixing) time under the mixer's particular running conditions and the resulting drop diameters is then presented in FIG. 5.

It is also found that the particle size breakup effect (particle size breakup performance) will become higher if it shows the same trend as the estimated values (theoretical values) obtained by the total energy dissipation rate $\epsilon_a$ is shown and if the gap δ in the mixer is small for the number of all rotations.

Note, however, that when the experimental results are arranged or organized into the graphical chart with the processing (mixing) time being plotted along the horizontal (X) coordinate axis, it is found that the change in the resulting drop diameter (particle size breakup trend) cannot be expressed (estimated) in the consistent manner.

Figure 6:
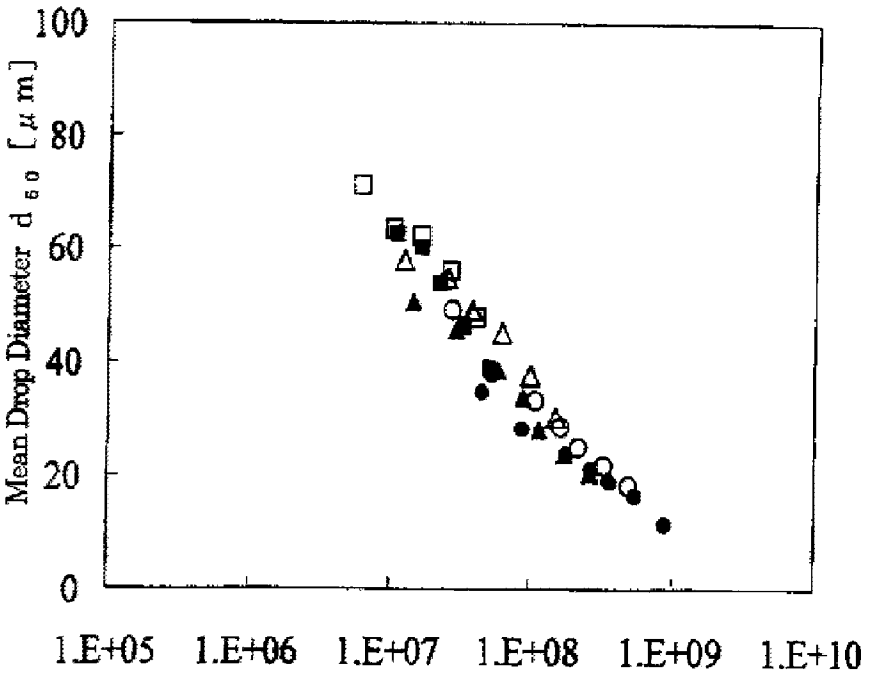
FIG. 6 represents the relationship (particle size breakup trend) between the total energy dissipation rate $\epsilon_a$ and the resulting drop diameters for the mixer of the rotor-stator type, in which the relationship (particle size breakup trend) between the processing (mixing) time and the resulting drop diameters is represented in FIG. 5.

Now, for the mixers A-1 and A-2, the relationship (particle size breakup trend) between the total energy dissipation rate $\epsilon_a$ as proposed by the present invention and the resulting drop diameters is presented in FIG. 6. When the experimental results are arranged or organized into the graphical chart with the total energy dissipation rate $\epsilon_a$ being plotted along the horizontal (X) coordinate axis, however, it may be found that the change in the resulting drop diameter (the particle size breakup trend) can be expressed (estimated) in the comprehensive manner.

Specifically, it is found that the resulting drop diameter exhibits the similar trend, that is, the resulting drop diameter will become smaller, regardless of whether there may be any differences in the running condition (the number of rotations and the mixing time) and the mixer configuration (the gap δ and the diameter of the rotor 3).

That is, it is confirmed that the total energy dissipation rate $\epsilon_a$ can serve as the index for estimating the mixer performance when the differences in the running condition and configuration for the mixer of the rotor-stator type are taken into account consistently.

Figure 7:
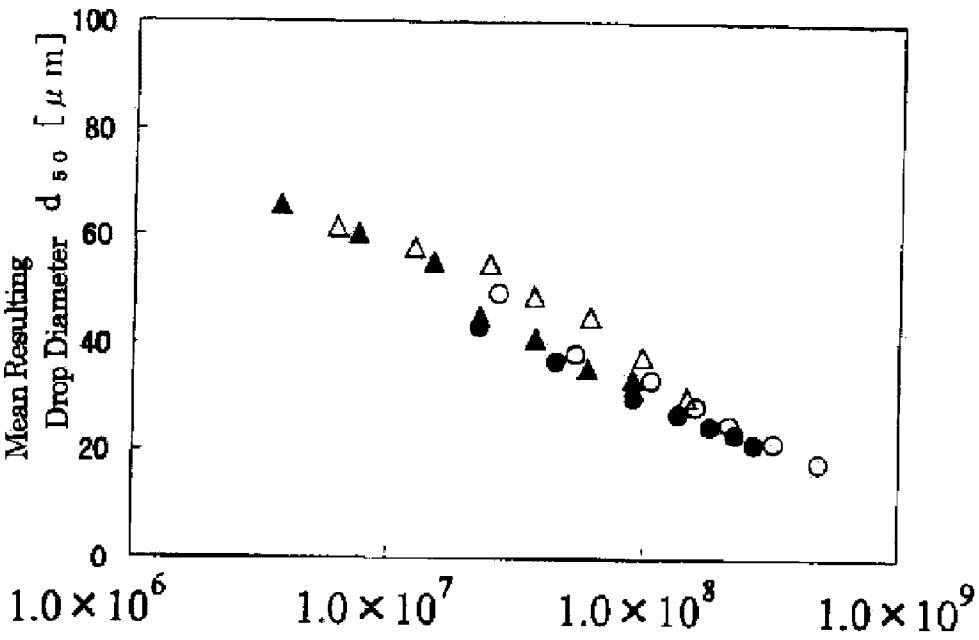
FIG. 7 represents the relationship (particle size breakup trend) between the total energy dissipation rate $\epsilon_a$ and the resulting drop diameters for the mixer of the rotor-stator type having the scale (size) different from that of the mixer of the rotor-stator type, in which the relationship (particle size breakup trend) between the processing (mixing) time and the resulting drop diameters is represented in FIG. 5.

For the mixer B in Table 2, the relationship (particle size breakup trend) between the total energy dissipation rate $\epsilon_a$ proposed by the present invention and the resulting drop diameters is presented in FIG. 7. From this relationship, it is found that the resulting drop diameter depends largely upon the values (magnitude) of the total energy dissipation rate $\epsilon_a$ regardless of the difference in the mixer's scale (size).

From FIG. 6 and FIG. 7, it may also be found that the particle size breakup effect will exhibit the similar trend regardless of the difference in the mixer's scale.

<The Estimation of Mixers Using the Total Energy Dissipation Rate $\epsilon_a$>

Now, the estimation of the mixer of the rotor-stator type using the Equation 1 of the present invention for deriving the total energy dissipation rate $\epsilon_a$, or more particularly the estimation of such mixers with the particle size breakup effect (the particle size breakup trend) being used as the index will be described below.

In the case where there are any differences in the size of the gap between the rotor and stator, the size (hole diameter) or configuration (hole number) of the opening (hole) of the stator or the like, the effect that each respective factor (each item) may have upon the performance of the stator of the mixer has been verified (estimated). The information regarding the mixer using that verification (estimation) is summarized in Table 4.

Note, however, that in estimating the performance of the actual mixer, the value of $K_c/K_{c_std}$ that may be obtained by normalizing the configuration dependent term $K_c$ with $K_c$ of Stator No. 3 (the standard stator) was used. This means that the particle size breakup effect will become higher (that is, the high performance mixer will be achieved) as this value for $K_c/K_{c_sted}$ is greater.

TABLE 4

Summary of Stator

| No. | Diameter of Opening [mm] | Ratio of Opening [%] | Gap [mm] |
|---|---|---|---|
| 1 | 1.5 | 24 | 1 |
| 2 | 2 | | |
| 3 | 4 | | |
| 4 | 6 | | |
| 5 | 4 | 12 | 1 |
| 6 | | 35 | |
| 7 | 4 | 24 | 0.5 |
| 8 | | | 2 |

Diameter of Rotor: 198 mm
Number of Rotor's Blades: 6

(Effect of the Gap between Rotor and Stator)

Figure 8:
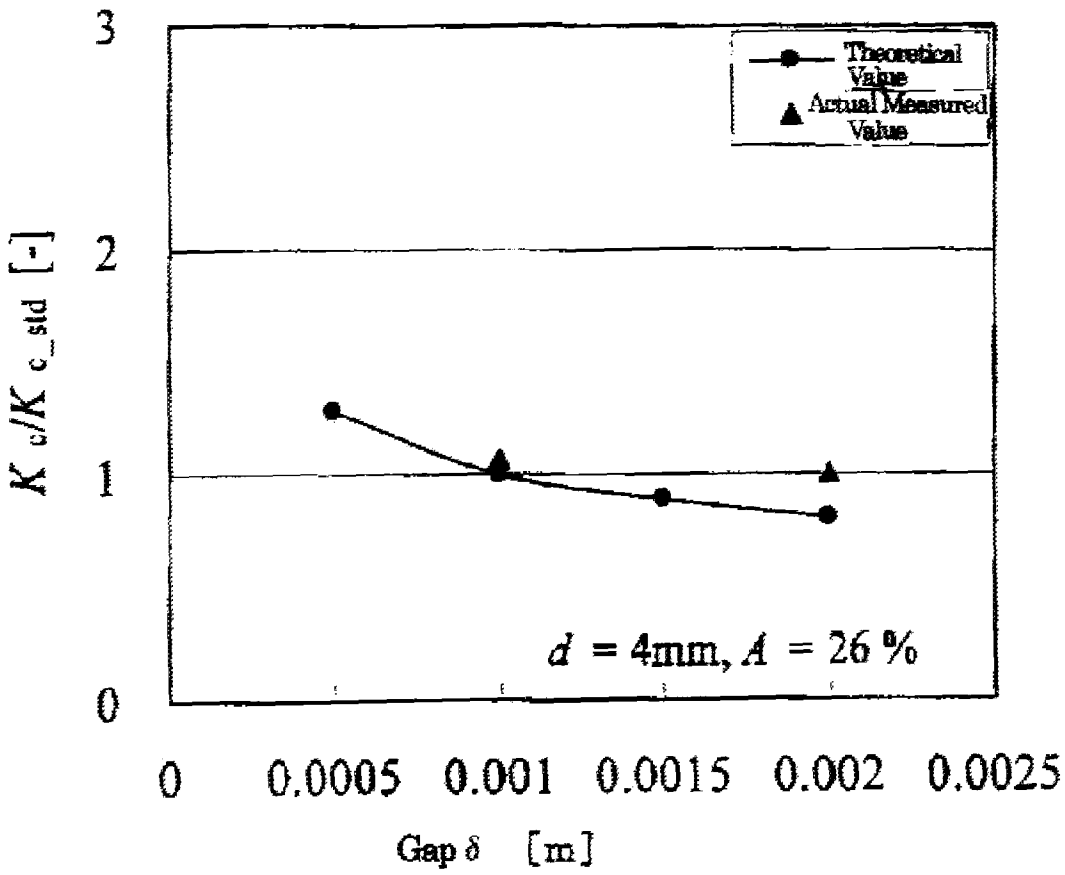
FIG. 8 represents the effect on the gap between the rotor and the stator.

The effect of the gap between the rotor and stator has been verified (estimated), the results of which are shown in FIG. 8.

When the particle size breakup effect (the particle size breakup trend) was calculated by using the Equation 1 of the present invention for deriving the total energy dissipation rate $K_c/K_{c_std}$, it was found that it could be estimated that the value for $K_c/K_{c_std}$ (theoretical value) would become greater as the gap between the rotor and stator was smaller.

When the particle size breakup effect of the mixer was calculated on the basis of the actual experimental results, on the other hand, it is found that the value of $K_c/K_{c_std}$ (actual measured value) would become greater as the gap was smaller.

For the relationship between the gap between the rotor and stator, it has been confirmed that the actual measured value and theoretical value of $K_c/K_{c_std}$ would exhibit the similar trend. Then, it was proved theoretically and experimentally that the performance of the mixer would become higher as the gap was smaller.

(Effect of Hole Diameter of Opening of Stator)

Figure 9:
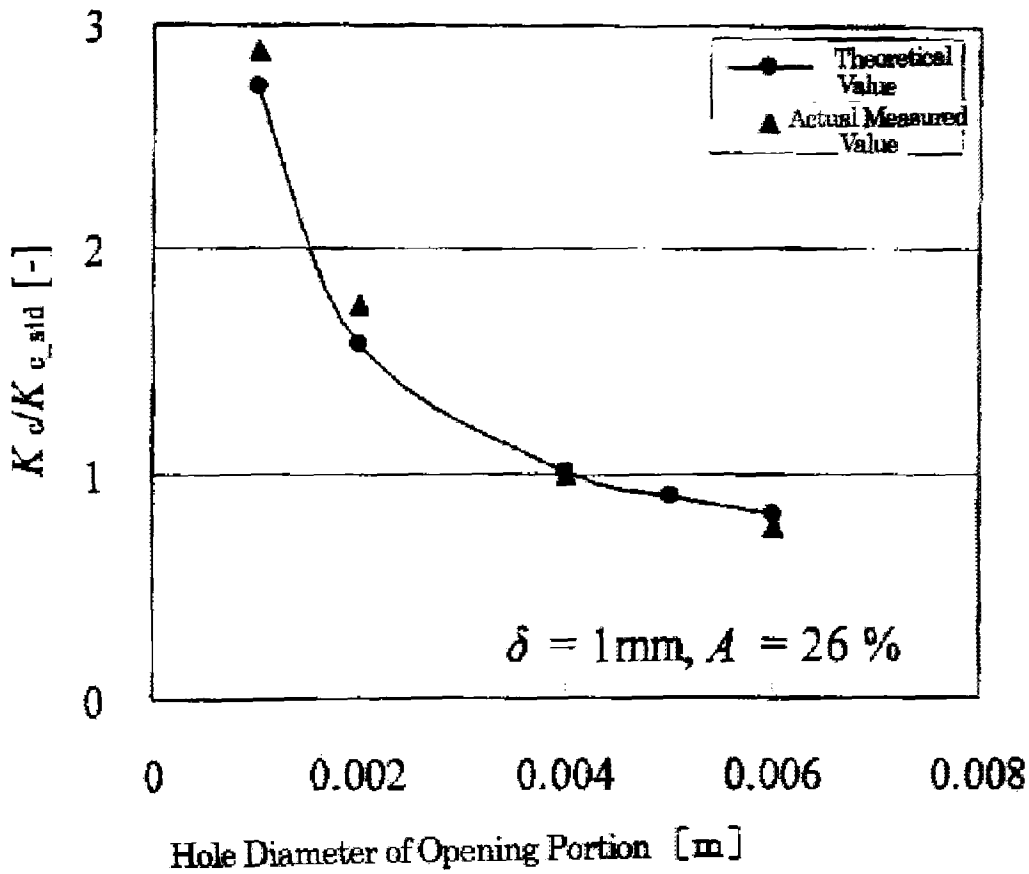
FIG. 9 represents the effect on the hole diameter of the opening in the stator.

The effect of the hole diameter of the stator was verified, the results of which are shown in FIG. 9.

When the particle size breakup effect (particle size breakup trend) was calculated by using the Equation 1 of the present invention for deriving the total energy dissipation rate $\epsilon_a$, it could be estimated that the value of $K_c/K_{c_std}$ (theoretical value) would become greater as the hole diameter of the stator was smaller.

When the particle size breakup effect of the mixer was calculated on the basis of the actual experimental results, on the other hand, it was found that the value of $K_c/K_{c_std}$ (actual measured value) would become greater as the hole diameter of the stator was smaller.

For the relationship between the gap between the rotor and stator, it was confirmed that the actual measured value and theoretical value of $K_c/K_{c_std}$ would exhibit the similar trend. Then, it was proved both and theoretically and experimentally that the performance of the mixer would become higher as the hole diameter of the stator was smaller.

It is found that the effect of the hole diameter of the stator is greater than the effect of the gap between the rotor and stator.

(Effect of Hole Number of Stator's Opening (Opening Area Ratio))

Figure 10:
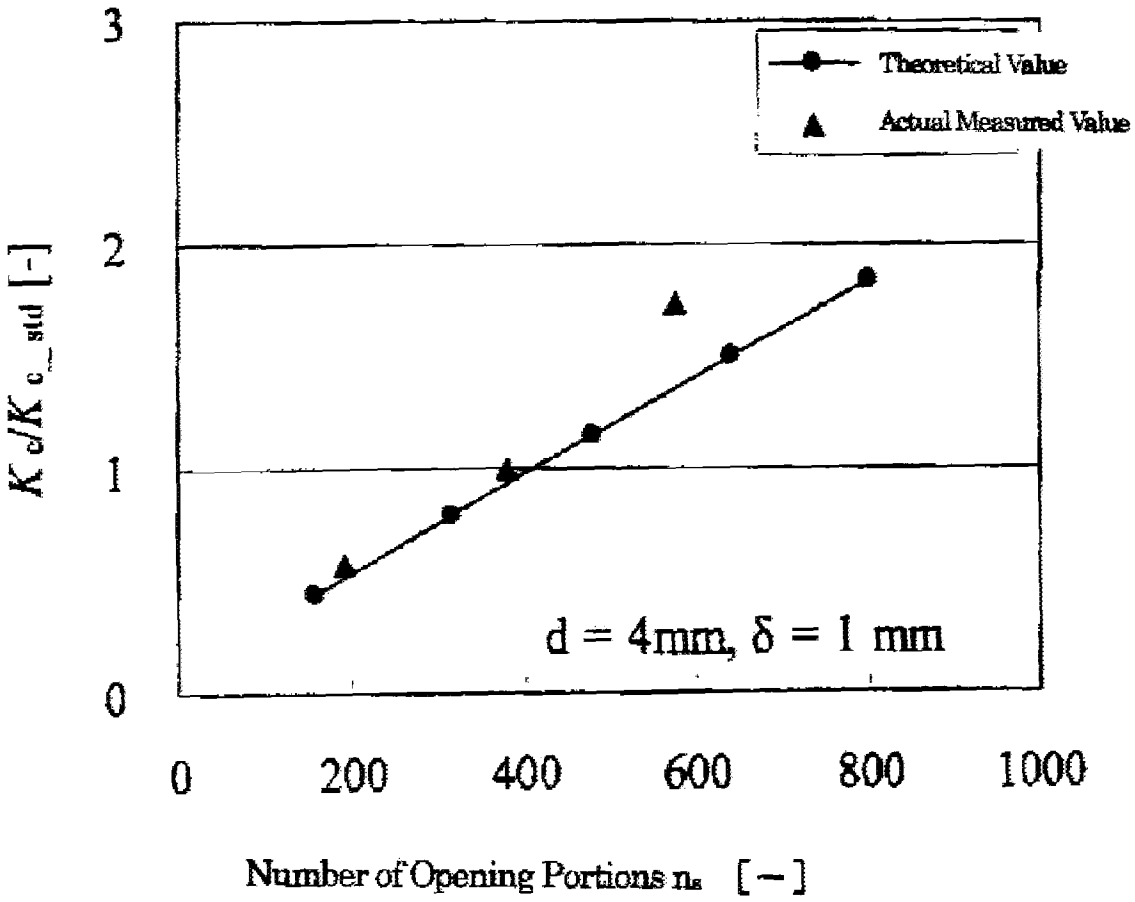
FIG. 10 represents the effect on the number of holes (opening area ratio) in the opening portion of the stator.

The effect of the hole number of the stator (the opening area ratio) has been verified, the results of which are shown in FIG. 10.

When the particle size breakup effect (particle size breakup trend) of the mixer was calculated on the basis of the Equation 1 of the present invention for deriving the total energy dissipation rate $\epsilon_a$, it was found that it could be estimated that the value of $K_c/K_{c_std}$ (theoretical value) would become greater as the hole number of the stator was greater.

When the particle size breakup effect was calculated on the basis of the actual experimental results, on the other hand, it was found that the value of $K_c/K_{c_std}$ (actual measured value) would become greater as the hole number of the stator was greater.

For the relationship between the hole number and particle size breakup effect for the stator, it was confirmed that the actual measured value and the theoretical value would exhibit the similar trend. Then, it was proved theoretically and experimentally that the performance of the mixer would become higher as the hole number (opening area ratio) of the stator was greater.

It is found that the effect of the hole number of the stator was greater than the effect of the gap between the rotor and stator.

(Effect of Improved Performance of the Existing (Commercially Available) Mixer)

Figure 11:
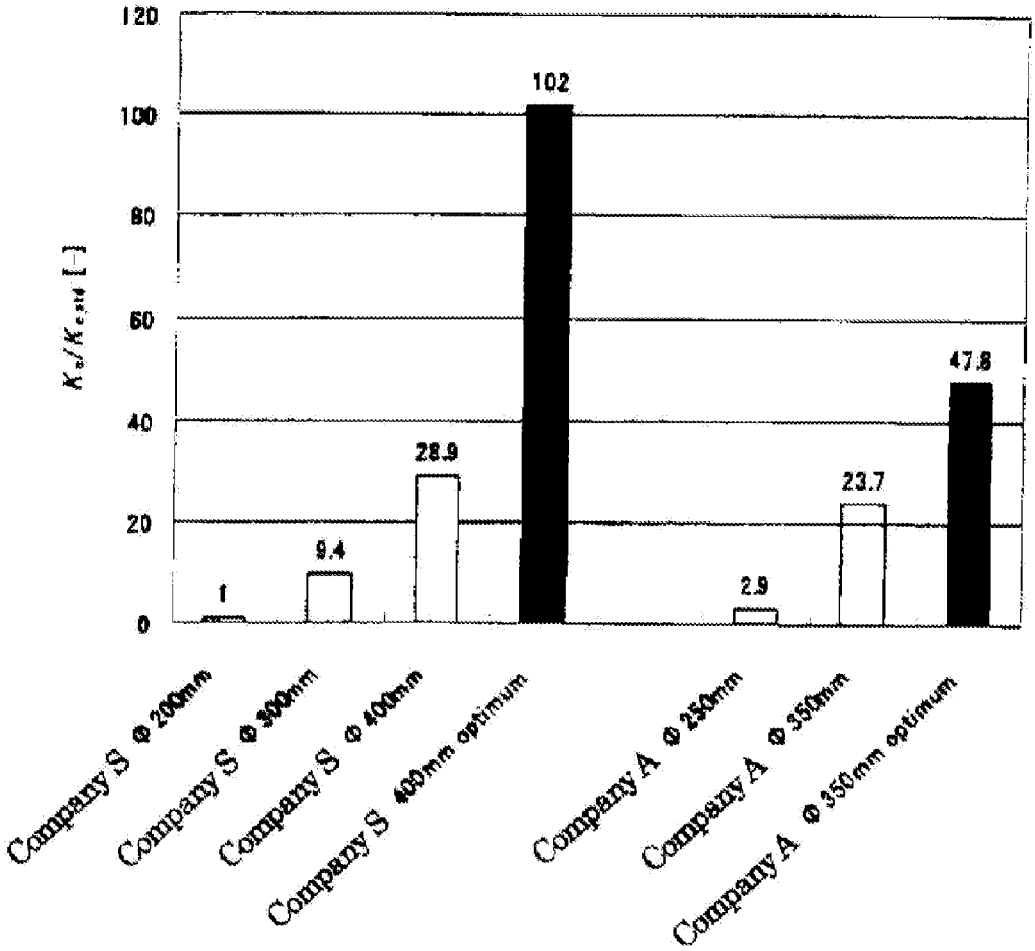
FIG. 11 represents the effect on the performance improvement effect for the conventional mixer.

The performances of the mixers that are commercially available from Company S and from Company A were compared on the basis of the Equation 1 of the present invention for deriving the total energy dissipation rate $\epsilon_a$, the results of which are shown in FIG. 11. The estimated values obtained by estimating the performance that can be expected to be improved when the configuration of the mixer of the present invention is modified on the basis of the design policy (design philosophy) of the mixer are also presented in FIG. 11. For the mixers offered by Company S and Company A, it is found that the performances can be estimated by applying the same index for those respective mixers although those mixers may have the diameters that are different from each other.

For the mixer of Company S (having the rotor diameter D of 400 mm), for example, it can be thought that the particle size breakup effect or emulsification effect (performance) can be expected to be improved by about 3.5 times by reducing the gap δ between the rotor and stator from 2 mm to 0.5 mm, increasing the hole number (opening area ratio) $n_s$ of the stator from 12% to 40%, and reducing the stator's hole diameter d form 4 mm to 3 mm. This means that the processing (running) time can be reduced remarkably by about 30% of the currently available time.

For the mixer of Company A (having the rotor diameter D of 350 mm), on the other hand, it can be thought that the particle size breakup effect or emulsification effect (performance) can be expected to be improved by about 2.0 times by reducing the gap δ between the rotor and stator from 0.7 mm to 0.5 mm, increasing the hole number (opening area ratio) $n_s$ of the stator from 25% to 40%, and reducing the stator's hole diameter d form 4 mm to 3 mm. This means that the processing (running) time can be reduced remarkably by half the currently available time.

(Configuration and Design of High Performance Mixer)

For the high performance mixer of the present invention, there is a mixing section that will be formed as the rotor is driven for rotation. The mixing section consists of several mixing stages (at least one or more mixing stages) such as one mixing stage located on the radially inner side and another mixing stage located on the radially outer side. The mixing section such as the one described here can provide the high performance mixer by improving the shear stress applied to the liquid being processed.

For the high performance mixer of the present invention, furthermore, the stators and the rotor are provided so that they can be moved relative to each other in the direction in which the rotary shaft of the rotor extends. Thus, the gap between the stators and the rotor can be changed and adjusted accordingly while the rotor is being rotated. This permits the shear stress applied to the liquid being processed to be changed and adjusted accordingly, and also permits the flow rate of the liquid being processed to be changed and adjusted accordingly.

In addition, the high performance mixer of the present invention includes a mechanism that allows the liquid being processed to be delivered (added) directly into the multi-stage mixing section described above. Thus, the high performance mixer can be provided by allowing this mechanism to cooperate with the multi-stage mixing section.

The configuration and structure of the high performance mixer proposed by the present invention as described above may be defined by using the mixer's performance estimation based on the total energy dissipation rate: $\epsilon_a$ derived from the Equation of the present invention as the index and by referencing the estimation results that may be obtained by mixer's performance estimation. The summary of the high performance mixer that may be designed by using the above definition is presented in FIGS. 12 through 16.

(Moving Stator (Movable Fixed Stator))

When the emulsified products are manufactured by dissolving (mixing) the powdery raw material or liquid raw material with the mixer of the rotor-stator type, and if the powdery raw material is processed by the mixer as the air that has been drawn with the powdery raw material remains not separated from the powdery raw material, fine air bubbles will be mixed (produced) into the mixed liquid. If the mixed liquid is emulsified as it contains those fine air bubbles, it has been known that the particle size breakup or emulsification performance (effect) will become worse as compared with the case where the mixed liquid that contains no such fine air bubbles is emulsified.

In order to prevent the fine air bubbles being produced at the initial stage of dissolving the powdery raw material, it is desirable that the mixer should be equipped with a moving stator mechanism. When the emulsified product that is easy to produce the fine air bubbles in particular, it is desirable that the mixer should be equipped with the moving stator mechanism. By moving the stator away from the rotor at the initial stage of dissolving the powdery raw material, the powdery raw material can be diffused into the mixed liquid quickly without causing the high energy to be dissipated. By bringing the stator closer to the rotor after then, the dissolving, particle size breaking up and emulsifying process can occur smoothly.

(Multistage Homogenizer (Multistage Emulsifying Mechanism)

As described above, it is confirmed that the particle size breakup or emulsifying performance (effect) can become better as the value of the total energy dissipation rate $\epsilon_a$ derived from the Equation 1 of the present invention is greater.

Here, the total energy dissipation rate $\epsilon_a$ can be expressed in terms of the product of the local energy dissipation rate $\epsilon 1$ and shear frequency $f_{s,h}$. In order to enhance the shear frequency $f_{s,h}$, it can be thought that it is effective that the stator has the multistage configuration when the particle size breakup or emulsification occurs. Specifically, the high performance mixer can be implemented when the two-stage or multistage stator is provided.

Specifically, the local energy dissipation rate $\epsilon 1$ and the shear frequency $f_{s,h}$ are defined as follows:

Local energy dissipation rate $\epsilon 1$: $\epsilon 1[m^2/s^3]=F_a U/\rho v_a$ $F_a$: Average Power [N]
U: Blade Tip Speed [m/s]
$\rho$: Density [kg/m$^2$]
$V_a$: Emulsification Contributory Volume [m$^{3]}$ Average Power: $F_a[N]=\tau_a S_a$ $\tau_a$: Average Shear Power [N/m$^2$]
$S_a$: Shear Area [m$^2$]

Average Shear Power: $\tau_a=P_h/Q$ $P_h$: Emulsification Contributory Power [kW]
Q: Flow Rate [m$^3$/h]

Emulsification Power Dissipation: $P_h[kW]=P_n-P_p$

Pn: Net Power [kW]
$P_p$: Pump Power [kW]

Shear Frequency $f_{s,h}[1/s]=n_d n_r N/n_v$ $n_s$: Number of Stator's Holes
$n_r$: Number of Rotor's Blades [Blades)
N: Number of Rotations [1/s]
$n_v$: Volume of Stator's Hole [m$^3$]

Shear Area: $S_a[m^2]=S_d+S_1$ $S_d$: Hole Cross Section
$S_1$: Hole Side Area [m$^2$]

Hole Cross Section: $S_d[m^2]=\pi/4d^2$ d: Stator's Hole Diameter

Hole Side Area: $S_1[m^2]=\pi d1$

1: Stator Thickness [m]

(Direct Injection (Adding Mechanism for Direction Injection Type))

From the mixer's performance estimation that occurs by using the total energy dissipation rate $\epsilon_a$ derived from the Equation of the present invention as the index and from the results obtained by verifying that performance estimation, it has been found that the particle size breakup effect or emulsification performance may be affected mainly by the hole diameter or number of holes (opening area ratio) of the stator's opening portion (hole).

Thus, the emulsification or dispersion can be performed more effectively by injecting (adding) fats, insoluble components, trace components or the like directly into the mixing section (mixer portion). Particularly, the emulsification or dispersion may be performed preliminarily by injecting those components directly into the first-stage stator (the stator which is located inwardly radially), and then the emulsification or dispersion may be performed on the full scale basis on the second-stage stator (the stator which is located outwardly.

(Configuration of High Performance Stator)

From the performance estimation of the mixer in which the total energy dissipation rate $\epsilon_a$ is used as the index and from the results that are obtained by verifying the above performance estimation, it is found that the mixer's performance will be enhanced when the hole diameter of the opening portion (hole) of the stator is as small as possible, the number of holes is as many as possible, and the gap between the rotor and stator is as small as possible. It is also found that the shear frequency will become higher as the number of the rotor's blades is greater.

Although it has been described above that the particle size breakup or emulsification performance (effect) will be enhanced as the gap between the rotor and stator is smaller, it is found from the current verification test that the particle size breakup or emulsification performance (effect) will be affected less by the hole diameter or hole number of the stator.

Rather, it is also found that there is the risk that the rotor and the stator will engage each other if the gap is smaller. When the moving stator mechanism is employed, it can cause the stator to be moved along the rotary shaft of the rotor while the mixer is running (operating). Thus, the gap (clearance) between the rotor and stator that is equal to about 0.5 mm to 1 mm is sufficient. To avoid the risk that the rotor and stator will engage each other, the gap should not be less than 0.5 mm.

In the current verification test, it is found that there is the risk that the powdery raw material or the like will cause clogging if the hole diameter of the stator is less than 2 mm. When the powdery raw material or the like is to be emulsified while it is to be dissolved, it is better that the hole diameter of the stator is about 2 mm to 4 mm.

Although the shearing frequency will become higher as the hole number (opening area ratio) of the stator is greater, the problem is the strength of the opening portion of the stator. In the prior art, the opening area ratio in most cases is generally 18% to 36%. In the current verification test, however, it is found that the opening area ratio should be equal to above 15%, preferably above 20%, more preferably above 30%, much more preferably above 40% or most preferably 40% to 50%.

(Optimal Hole Configuration of Stator as Compared in Respect to Same Diameter and Same Opening Area Ratio)

It is better that the stator's hole should have the round configuration rather than the saw teeth configuration. It is known that the local energy dissipation rate $\epsilon_a$ is in proportion to the shear area $S_a$. Given the identical sectional area, therefore, the shear sectional area $S_a$ for the round configuration becomes the greatest. It can be thought that the particle size breakup effect or emulsification performance will be performed more effectively for the round configuration than for the saw teeth configuration.

The total energy dissipation rate $\epsilon_a$ has been calculated for the mixer in which the opening formed in the stator has the different configurations such as the round, square and rectangular with the other parameters being the same, the results of which are presented in Table 5.

TABLE 5

Comparison of Configurations of Opening for Stator

| | | | Round Cross Section | Square Cross Section | Rectangular Cross Section (Aspect Ratio 2) | Rectangular Cross Section (Aspect Ratio 3) | |
|---|---|---|---|---|---|---|---|
| Length of Diameter or One Side | d | [m] | | | 0.004 | | |
| Thickness of Stator | l | [m] | | | 0.0025 | | |
| Height of Stator | h | [m] | | | 0.032 | | |
| Inner Diameter of Stator | D | [m] | | | 0.2 | | |
| Ratio of Opening | a | [—] | | | 0.24 | | |
| Area of Opening | S | [$m^2$] | | | 2.01E−02 | | |
| Cross Sectional Area per One Hole | $S_d$ | [$m^2$] | 1.26E−05 | 1.60E−05 | 3.20E−05 | 4.80E−05 | |
| Number of Holes | $n_s$ | [—] | 1600 | 1257 | 628 | 419 | |
| Shear Cross Sectional Area | $S_s$ | [$m^2$] | 4.40E−05 | 5.60E−05 | 9.20E−05 | 1.28E−04 | |
| Configuration Factor | K | [$m^2$] | 0.070 | 0.070 | 0.068 | 0.054 | $S_s \times n_s$ |
| Ratio | α | [—] | 1.000 | 1.000 | 0.821 | 0.762 | |
| | | | Reference | Equal | Smaller | Smaller | |

More specifically, the number of holes will become greater and the shear cross sectional area will also become larger for the round or square configuration than for the saw teeth configuration (rectangular cross sectional area), provided that those configurations have the same hole diameter and opening portion area. Thus, the total energy dissipation rate $\epsilon_a$ will also become higher, and the particle size breakup or emulsification performance for the mixer will become better for the round or square configuration of the opening portion.

From the comparison of the configuration factors in Table 5, it is clear that the performance is equal both for the square and round configurations. For the square configuration, however, more time and labor would be involved when it is worked. Thus, it may be thought that the round configuration will provide the optimal particle size breakup or emulsification performance and workability.

(Number of Rotor's Agitating Blades)

From the aspect of the higher shear frequency, the rotor's agitating blades will become better as its number is greater. If the outlet flow rate is decreased, however, the number of flow circulations through the tank will be reduced. As a result, the particle size breakup effect or emulsification performance can become lower. From the theoretical equation as defined previously, it may be understood that the total energy dissipation rate $\epsilon_a$ will become higher as the number of the rotor's blades is greater. Generally, the rotor includes six blades, but it is clear that the particle size breakup or emulsification performance (effect) may be increased by about 1.3 times simply by providing eight blades for the rotor.

(Scaling up the Mixer)

The scale up method may be utilized by performing the verification test while using the index (theory) as proposed by the present invention. Particularly, the scale up method will be useful if the processing (mixing) time is taken into consideration.

(Comparison Between the Existing Mixer and the Inventive Novel Mixer)

The results obtained by comparing the existing typical mixer with the novel mixer proposed by the present invention regarding their respective features are presented in Table 6.

TABLE 6

Comparison between Existing Mixer and Inventive Mixer

| | | | | | Company D | | |
|---|---|---|---|---|---|---|---|
| | Inventive Mixer | Company A | Company B | Company C | D-1type | D-2type | Company E |
| Moving Stator | ○ | ○ | x | x | ○ | x | x |
| Multistage | ○ | x | ○ | x | x | ○ | ○ |
| Direct Injection | ○ | x | ○ | x | x | x | x |
| Gap | 0.5~1 mm | 1~2 mm | 0.3~0.8 mm | 0.7 mm | 0.5~1 mm | 0.5~1 mm | 0.25~1 mm |
| Configuration of Stator | Round | Round Slit | Slit | Round Slit | Slit | Slit | Slit |
| Ratio of Opening | 40% | 12~36% | Saw Teeth | 25% | Saw Teeth | Saw Teeth | Saw Teeth |
| Number of Rotor's Blades | 8 | 6 | Saw Teeth | 6 | Saw Teeth | Saw Teeth | Saw Teeth |

At present, the mixer that includes the features of "the moving stator" feature, "the multistage homogenizer" and/or "the direct injection" is not available. It may be appreciated that the mixer that has the optimal stator configuration (gap, hole diameter, opening area ratio, and hole shape) and the optimal rotor configuration (blades and blade width) provides the improved emulsification and particle size breakup performance (effect).

The results that were obtained by examining the relationship between the total energy dissipation rate: $\epsilon_a$ derived from the Equation of the present invention as described above and the resulting liquid drop diameters (the particle size breakup trend) are given below.

In this examination, the three types of the mixer were compared in respect of their respective performances. For each of the three types of the mixer, the gap δ between the rotor 3 and the stator 2 is great (δ>1 mm, such as δ=2 to 10 mm, for example), and the stator 2 has a great number of openings (holes) 1 (the number of openings: $n_s$>20, such as $n_s$=50 to 500, for example).

In the examination described above, it should be noted that the liquid that simulates a dairy product and has the composition ratio in Table 1 was used as an object of estimating the resulting particle size breakup. As shown in FIG. 3, the device that employs the externally circulated mode was prepared for use for this purpose, and the liquid drop diameters that would result on the middle way of the flow path were measured by using the laser diffraction type particle size analyzer (SALD-2000 offered by Shimazu Manufacturing Corporation), and the particle size breakup trend for the resulting liquid drop diameters was examined in order to estimate the trend.

The mixer C (having the capacity of 100 liters), the mixer D (having the capacity of 500 liters), and the mixer E (having the capacity of 10 kiloliters) ware used in this embodiment, and the summary for those three mixers is presented in Table 7. Those three mixers are offered from the same manufacturers, and are available on the commercial market. For the mixer C, five mixers (Stator No. 1 to Stator No. 5), each of which is different in the size of the gap δ and the number of openings 1, were examined.

Since the values for $Kg/(K_g+K_s)$ range between 0.1 and 0.3 as seen from Table 8, the configuration dependent term $K_s$ for the stator will be greater than the configuration dependent term $K_g$ for the gap. For the mixer C in Table 7, therefore, it is found that the particle size breakup effect for the opening portion 1 on the stator 2 is greater and more dominating.

As it is clear from the value for $K_c/K_{c_std}$ which is normalized by $K_c$ for the stator No. 4 in Table 8, it can be estimated that the particle size breakup effect will become higher as the number of the stator is greater.

Figure 12:
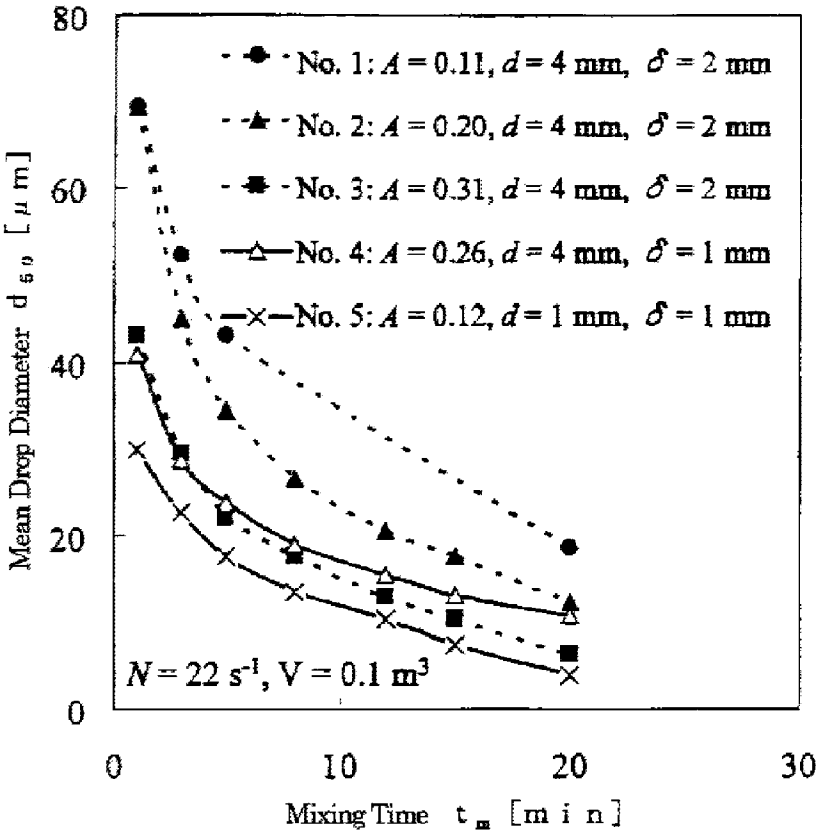
FIG. 12 represents the relationship between the processing (mixing) time and the resulting liquid drop diameters for the particular small-size mixer (particle size breakup trend) under the running condition as presented in Table 5.

For the mixer C (Stator No. 1-Stator No. 5), the relationship (particle size breakup trend) between the processing (mixing) time and the resulting drop diameters under the mixer running condition in Table 8 is shown in FIG. 12.

It is found that the particle size breakup effect (particle size breakup performance) exhibits the same trend as the values to be estimated by $K_c/K_{c_std}$ in Table 8 and the particle size breakup effect, and is higher for any of Stator No. 1 to Stator No. 5 when the values for $K_c/Kc___{std}$ are large. When the processing (mixing) time under mixer's running conditions is thought to be adequate, it is found that the area ratio of the opening is good when it is above 0.15 (15%), preferably above 0.2 (20%), more preferably above 0.3 (30%), much more preferably 0.4 (40%), or most preferably 0.4 to 0.5 (40 to 50%). Thus, it is better to consider the strength of the opening for the stator.

For the Stator No. 3 and Stator No. 4 that have the equivalent values for $K_c/Kc___{std}$, they show the equivalent particle size breakup trend. When the mixer's performance is estimated by the values for $K_c/Kc___{std}$ and the values for the total energy dissipation rate $\epsilon_a$ that can obtained by the Equation 1 of the present invention, therefore, it is found that the trend can be explained not only quantitatively but also qualitatively.

When the experimental results are arranged into the graphical chart with the processing (mixing) time being plotted along the X coordinate axis, it is found that the change in

TABLE 7

Summary of Mixers

| | Mixer C 100 L | | | | | Mixer D 500 L | Mixer E 10 kL |
|---|---|---|---|---|---|---|---|
| Stator No. | 1 | 2 | 3 | 4 | 5 | 6 | 7 |
| Rotor's Diameter [mm] D | 198 | 198 | 198 | 198 | 198 | 198 | 396 |
| Stator's Opening Diameter [mm] d | 4 | 4 | 4 | 4 | 1 | 4 | 4 |
| Ratio of Opening [—] A | 0.11 | 0.20 | 0.31 | 0.26 | 0.12 | 0.26 | 0.18 |
| Number of Openings [—] $n_s$ | 173 | 316 | 500 | 411 | 3090 | 414 | 1020 |
| Size of Gap [mm] δ | 2 | 2 | 2 | 1 | 1 | 1 | 2 |

Number of Rotor Blades $n_r$: 6

In Table 7, it is noted that the opening aria ratio A is the dimensionless quantity that is measured in terms of the "all opening area ratios (=one hole area×number of holes)/stator's surface area".

The experimental conditions and the values calculated for the total energy dissipation rate $\epsilon_a$ under the running condition are presented in Table 8.

TABLE 8

Experimental Conditions and Calculated Values

| State No. (Mixer C) | 1 | 2 | 3 | 4 | 5 |
|---|---|---|---|---|---|
| Configuration Dependent Term $K_c$ [$m^5$] | $3.52 \times 10^{-3}$ | $8.51 \times 10^{-3}$ | $1.43 \times 10^{-3}$ | $1.54 \times 10^{-2}$ | $3.14 \times 10^{-2}$ |
| Ratio of Configuration Dependent Term $K_c/K_{c_std}$ [—] | 0.23 | 0.55 | 0.93 | 1.00 | 2.04 |
| Total Energy Dissipation Rate $\epsilon_a$ [$m^2/s^3$] | $6.67 \times 10^3$ | $19.8 \times 10^3$ | $33.1 \times 10^3$ | $35.6 \times 10^3$ | $73.0 \times 10^3$ |

N = 1317 [rpm], V = 0.1 [$m^3$]

the drop diameters (particle size breakup trend for the drop diameters) cannot be expressed (estimated) consistently.

Figure 13:
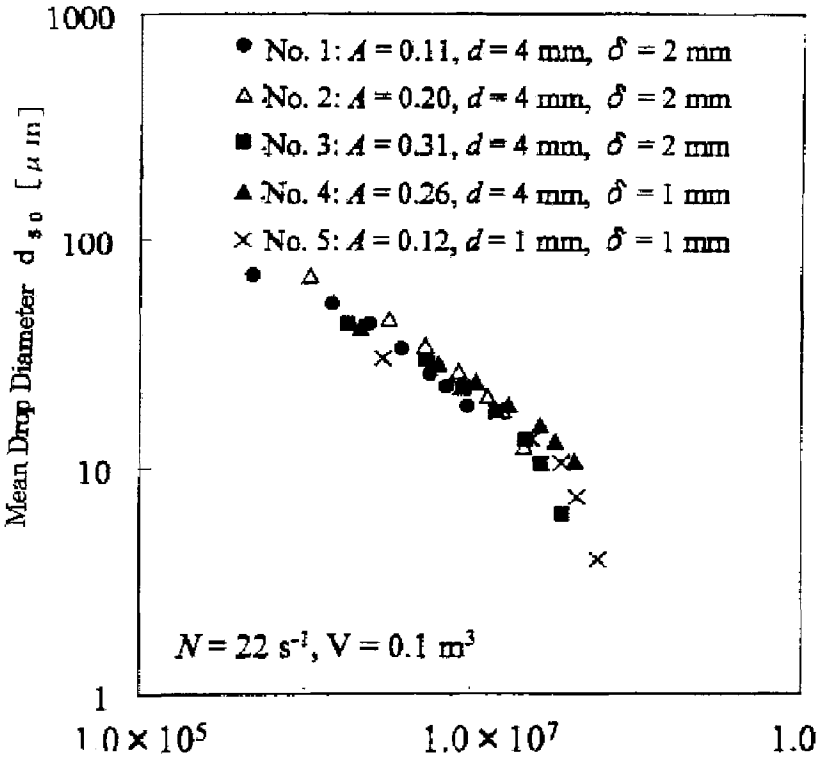
FIG. 13 represents the relationship between the total energy dissipation rate: $\epsilon_a$ and the resulting liquid drop diameters for the particular large-size mixer (particle size breakup trend) under the running condition as presented in Table 5.

Now, for the mixer C (Stator No. 1 to Stator No. 5) in Table 7, the relationship (particle size breakup trend) between the total energy dissipation rate $\epsilon_a$ to be obtained by the Equation 1 and the resulting drop diameters is presented in FIG. 13.

When the experimental results are arranged or organized into the graphical chart with the processing (mixing) time being plotted along the X coordinate axis, it is found that the change in the drop diameters (particle size breakup trend for the drop diameters) can be represented (estimated) consistently. As this is explained specifically, it is found that the drop diameter follows the similar trend and is decreasing, even though there are differences in the mixer's running condition (the number of rotations, mixing time) and the configuration of the mixer (gap, stator's hole diameter, stator's opening area ratio).

That is, it has been confirmed that the total energy dissipation rate $\epsilon_a$ that can be obtained by the Equation 1 of the present invention may serve as the index that can be used to estimate the mixer of the rotor-stator type in particular, when the differences in the mixer's running condition and configuration are considered consistently.

Figure 14:
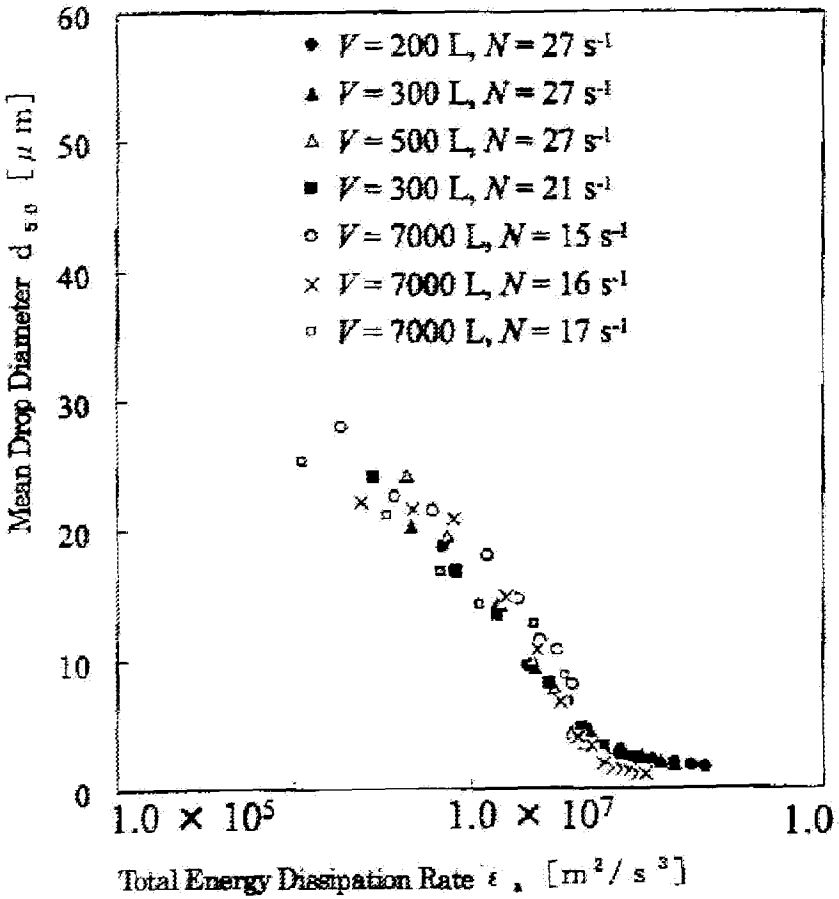
FIG. 14 represents the relationship between the total energy dissipation rate: $\epsilon_a$ and the resulting liquid drop diameters (particle size breakup trend) for other large-size mixers as presented in Table 5.

For the mixers D and E in Table 7, the relationship (particle size breakup trend) between the total energy dissipation rate $\epsilon_a$ that can be obtained by the Equation of the present invention and the resulting drop diameters is presented in FIG. 14. It is found that the drop diameter depends on the value (magnitude) for the total energy dissipation rate $\epsilon_a$ even though the scale (size) of the mixer may have the different capacity such as 200 to 700 liters. The drop diameter has the similar trend even though the scale (size) of the mixer is different.

For the mixers of the rotor-stator type in which the gap $\delta$ between the rotor 3 and stator 2 is larger ($\delta$>1 mm, e.g. $\delta$=2 to 10 mm), and the number of openings (holes) 1 for the stator 2 is larger ($n_s$>20, e.g. $n_s$=50 to 5000), it can be thought from the above that those mixers can be scaled up by agreeing with the values (magnitudes) of the total energy dissipation rate $\epsilon_a$ that can be obtained by the Equation 1 of the present invention and by considering that there are the differences in the mixer's running condition and configuration consistently.

It may be appreciated from the above description that the changes in the relationship between the total energy dissipation rate: $\epsilon_a$ to be derived from the Equation of the present invention and the resulting liquid drop diameters (particle size breakup trend) can be described (evaluated) collectively with the total energy dissipation rate: $\epsilon_a$ being plotted along the horizontal axis.

By the above examination conducted by the inventor of the present application, it has been recognized that there is a nearly linear relationship between the total energy dissipation rate: $\epsilon_a$ that can be obtained by the Equation of the present invention as described and the resulting liquid drop diameters.

Because it is difficult to derive the experimental equation that can be trusted statistically, the estimation of the liquid drop diameters has been made by using the relationship between the liquid drop diameters obtained experimentally and the total energy dissipation rate: $\epsilon_a$ obtained by the Equation of the present invention.

As described above, the total energy dissipation rate: $\epsilon_a$ obtained by the Equation of the present invention may be divided into the configuration dependent terms and other manufacturing conditions (including the time). The total energy dissipation rate: $\epsilon_a$ will become larger as the configuration dependent term (time) with the manufacturing condition term being fixed is larger. The result is that the liquid drop diameters will be smaller under the same manufacturing condition (time).

As this is described specifically, the particle size diameters can actually be measured under certain manufacturing condition, and the value for $\epsilon_a$ can then be calculated. By this experiment, the value for $\epsilon_a$ that is required for obtaining the particular liquid drop diameters can be determined.

By comparing the value for $\epsilon_a$ obtained when the mixer's configuration has been changed and the magnitude for $\epsilon_a$ before the mixer's configuration will be changed, the trend of decreasing the liquid drop diameter after the mixer's configuration has been changed will be able to be estimated.

Although the equation described before and the experimental equation that can be highly trusted statistically are not available, it will be possible to estimate the trend of decreasing the liquid drop diameters by considering the effect of the mixer's configuration on the liquid drop diameters.

EMBODIMENTS

Several preferred embodiments of the present invention and some of the examples thereof will now be described with the particular reference to the accompanying drawings. It should be understood that the present invention is not restricted to those embodiments and examples, but the preferred embodiments may be modified in numerous ways without departing from the technical scope defined in the appended claims.

Now, the high performance mixer will be described in general terms by using FIGS. 15 to 19, wherein the total energy dissipation rate $\epsilon_a$ that may be derived from the Equation 1 as proposed by the present invention is may be used as the index, the performance estimation may be made by using the value $\epsilon_a$ as the index, the high-performance mixer's configuration may be defined by the verification results of the performance estimation, and the high-performance mixer may be designed on the basis of that definition.

The mixer of the rotor-stator type as proposed by the present invention may be characterized by the fact that it comprises a mixer unit 14 that includes a stator having a plurality of opening portions (holes) and a rotor disposed on the inner side of the stator and spaced by a particular gap away from the stator. The other components are the same as those included in the conventional mixer of the rotor-stator type. In the following description, one typical example of the mixer unit 14 of the mixer according to the present invention is provided.

Figure 15:
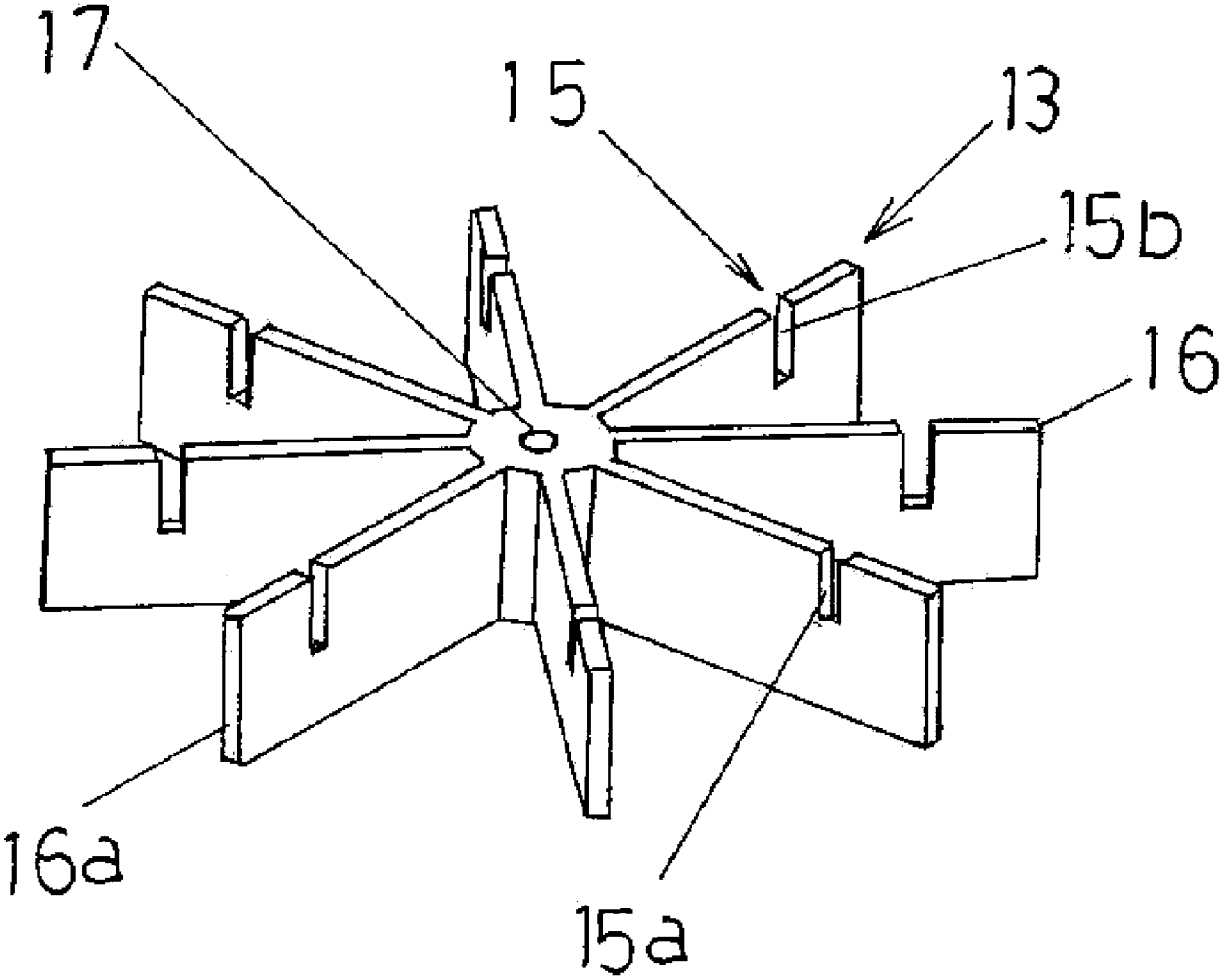
FIG. 15 is a perspective view for explaining an example of a rotor that is employed in the rotor-stator type mixer of the present invention.
Figure 16:
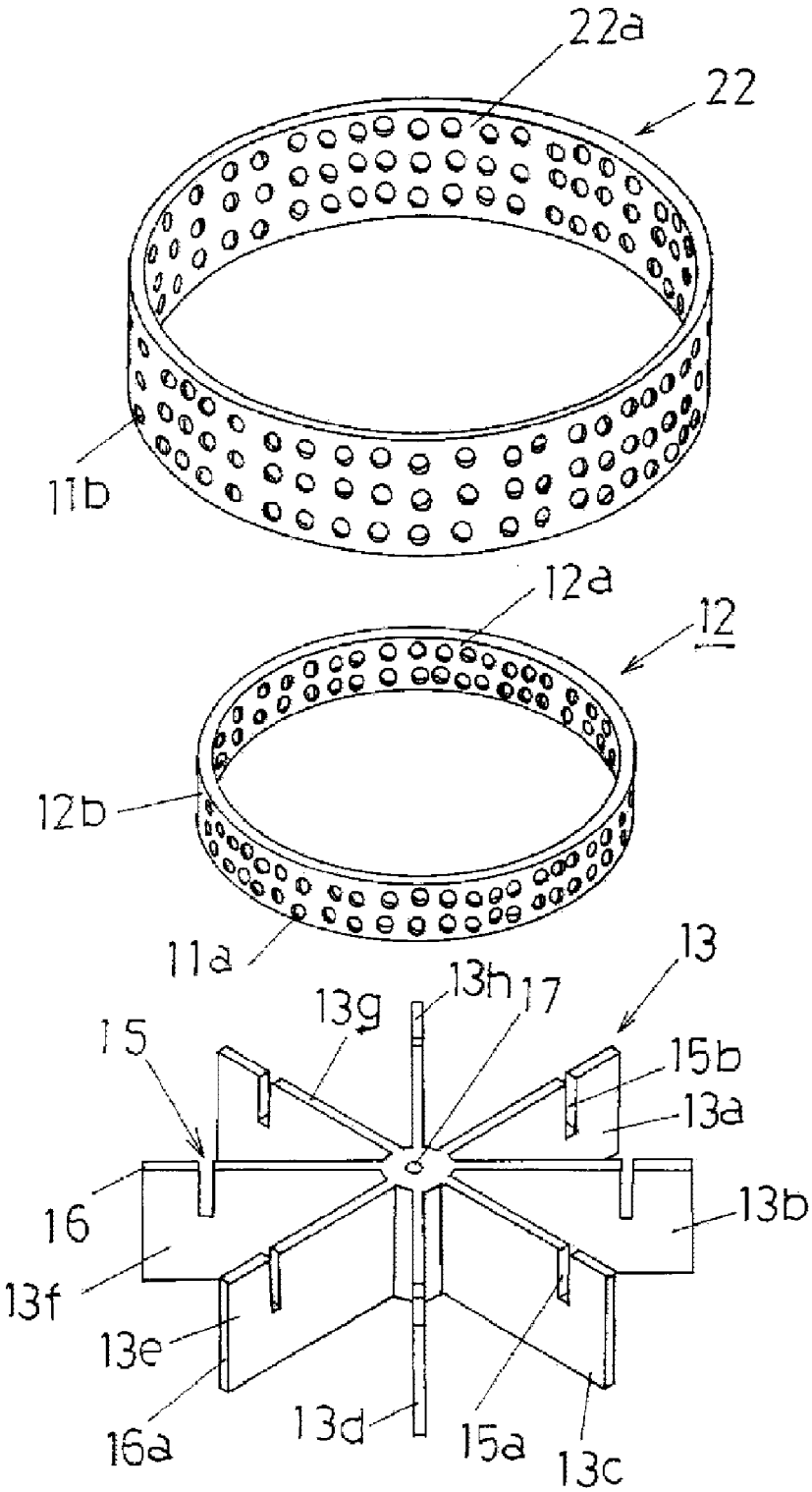
FIG. 16 is an exploded perspective view illustrating one example of the multistage emulsification mechanism that may be employed in the mixer of the rotor-stator type according to the present invention.

The mixer unit 14 in the mixer of the rotor-stator type according to the present invention includes the rotor 13 and stators 12, 22 each having the construction as shown in FIG. 15 and FIG. 16.

Each of the stators 12, 22 has a plurality of round-shape opening portions 11*a*, 11*b* like the stator 2 in the conventional mixer unit 14. The stators 12, 22, the stator 22 of which is diametrically greater then the stator 22, may be arranged co-centrically around the mixer unit 14 as shown in FIG. 17 (*a*).

The rotor 13 which is disposed on the inner side of the stators 12, 22 and spaced by the particular gap away from the stators 12, 22 has a plurality of agitating blades extending radially from the rotary shaft 17 around which the rotor 13 rotates. In the embodiment shown, eight agitating blades 13*a*, 13*b*, 13*c*, 13*d*, 13*e*, 13*f*, 13*g*, 13*h* are provided.

Each of the agitating blades 13*a* to 13*h* has a longitudinal groove 15 that has the same diameter between the center and the outermost end 16 in the radial direction thereof.

Figure 17:
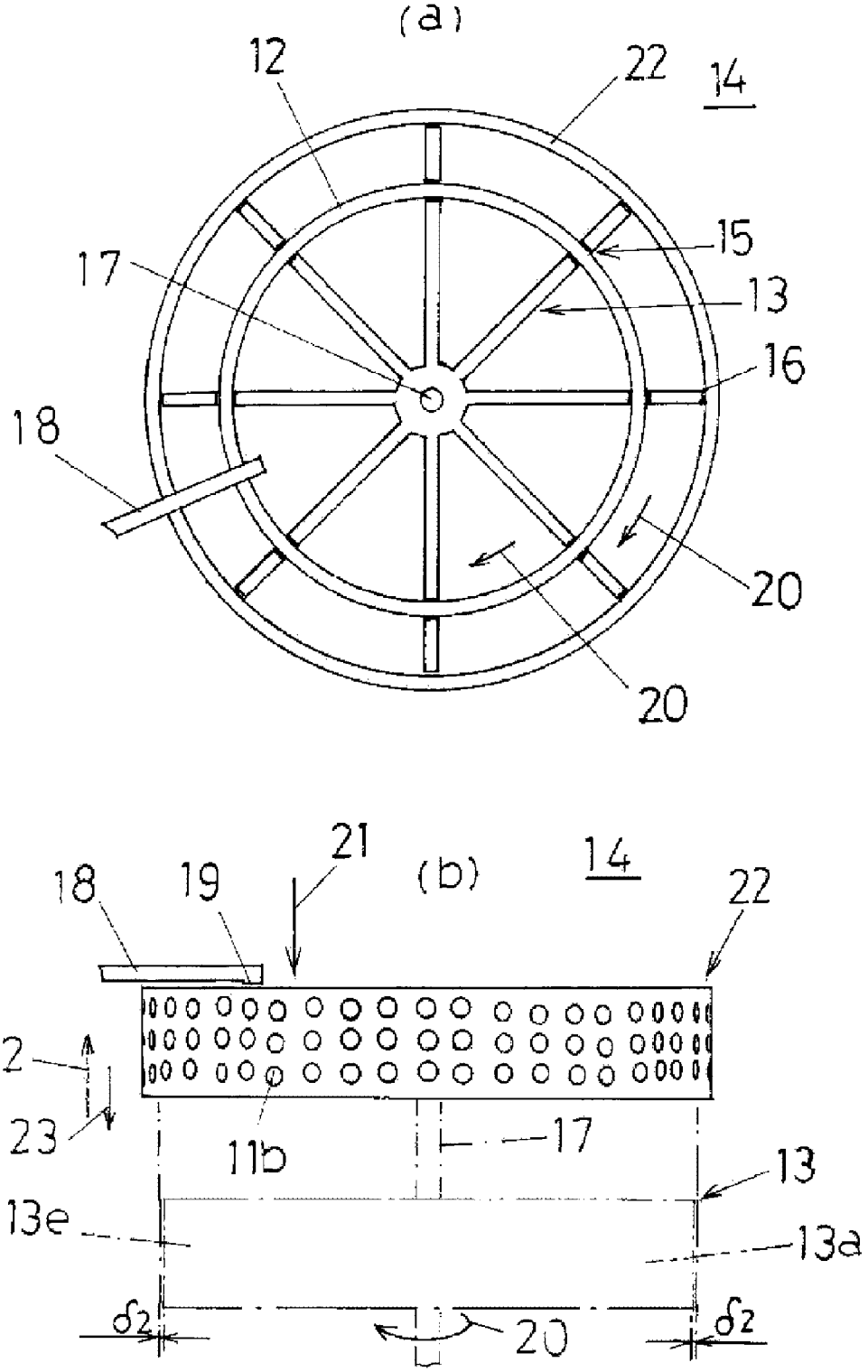
FIG. 17 illustrates the direct injection system that may be employed in the mixer of the rotor-stator type, in which (a) represents a plan view and (b) represents a side view.

When the mixer unit 14 is to be formed as shown in FIGS. 17 (*a*) and (*b*), the stator may be fitted into the longitudinal groove 15 on each of the agitating blades 13*a* to 13*h*. Then, the gap δ 2 may be formed between the wall surface 16*a* on the radially outermost end 16 of each of the agitating blades 13*a* to 13*h* and the inner peripheral wall surface 22*a* of the stator 22. Gaps may also be formed between the outer circumferential surface 15*a* in the longitudinal groove 15 of each of the agitating blades 13*a* to 13*h* and the inner peripheral wall surface 12*a* of the stator, and between the inner circumferential surface 15*b* in the longitudinal groove 15 of each of the agitating blades 13*a* to 13*h* and the outer peripheral wall surface 12*b* of the stator 12.

It may be understood from the above that the mixer unit 14 in the mixer of the rotor-stator type according to the present invention has the construction in which the rotor is disposed on the inner side of each of the plurality of stators each having a different diameter and spaced by the particular gap from each of the stators.

When the rotor 13 is rotated about the center of the rotary shaft 17 as indicated by the arrow 20, the two-stage mixing sections including the mixing section located inwardly radially and the mixing section located outwardly radially. This multistage mixing structure can provide the high performance mixer. More specifically, the shear stress that is applied to the liquid being processed can be improved by providing the multi-stage mixing section as described above.

In the embodiment shown, the mixing portion located inwardly radially may be formed between the outer circumferential surface 15*a* in the longitudinal groove on each of the agitating blades 13*a* to 13*b* and the inner peripheral wall surface 12*a* of the stator 12 and between the inner circumferential surface 15*b* in the longitudinal groove 15 of each of the agitating blades 13*a* to 13*h* and the outer circumferential water surface 12*b* of the stator 12, while the mixing section located outwardly radially may be formed between the wall surface 16*a* on the radially outward end 16 of each of the agitating blades 13*a* to 13*h* and the inner peripheral wall surface 22*a* of the stator 22. Similarly, the mixing stage that is located on the radially outer side will be formed between the wall surface 16*a* located on the radially outer end 16 of each of the stirring blades 13*a* to 13*h* and the inner circumferential wall surface 22*a* of the stator 22.

In the mixer of the present invention, the stators 12, 22 and the rotor 13 are arranged so that they can be moved closer to each other or away from each other in the direction in which the rotary shaft 17 of the rotor 13 extends. In the embodiment shown, they can be moved relatively to each other as indicated by the arrows 22, 23 in FIG. 17 (*b*) in the direction in which the rotary shaft 17 of the rotor 13 extends.

In the mixer of the present invention, the rotor 13 may be moved in the direction of the arrow 22 in FIG. 17(*b*), and then the mixer unit 14 may be formed by having the stator 12 fitted into the longitudinal groove 15 on each of the agitating blades 13*a* to 13*h* as described previously, and the rotor 13 may be moved away from the stators 12, 22 as shown by the imaginary line in FIG. 17 (*b*).

At the initial stage in which the powdery raw material is dissolved by the mixer, the powdery raw material may be dispersed quickly into the mixed liquid by causing the rotor 13 to be moved away from the stators 12, 22 as indicated by the arrow 23 in FIG. 17 (*b*) without causing the high energy to be dissipated.

After the above step, the two-stage mixing section including the mixing portion located inwardly radially and the mixing portion located outwardly radially may be formed by causing the rotor 13 to be moved as indicated by the arrow 22 in FIG. 17 (*b*), and the dissolution, particle size breakup and emulsification steps may be performed on the full scale basis by causing the rotor 13 to be rotated in the direction of the arrow 20 in FIG. 17 (*b*).

As it is apparent from the above description, the stators 12, 22 and the rotor 13 are capable of rotating in the direction in which the rotary shaft 17 of the rotor 13 extends, and therefore the gap between the stators and the rotor can be changed and adjusted accordingly while the rotor 13 is being rotated. Similarly, the shear stress applied to the liquid being processed can be changed or adjusted accordingly, and the flow rate of the liquid being processed can also be changed or adjusted accordingly.

In the mixer of the present invention, a nozzle 18 is provided such that it extends radially toward the center along the upper ends of the stators 12, 22 forming the mixer unit 14, and the fluid or liquid being processed may be delivered directly into the mixing section as shown by the arrow 21 in FIG. 17 (*b*) through the outlet 19 of the nozzle 18.

More specifically, the fluid or liquid being processed can be delivered directly through the nozzle outlet 19 into the inward mixing portion as indicated by the arrow 21, that is, between the outer circumferential surface 15*a* in the longitudinal groove 15 on each of the agitating blades 13*a* to 13*h* and the inner peripheral wall surface 12*a* of the stator 12, where the mixing (preliminary mixing) process may occur in the first-stage mixing portion. Following this, the mixing process may occur on the full scale basis in the outward mixing portion, that is, between the wall surface 16*a* of the radially outward end 16 of each of the agitating blades 13*a* to 13*h* and the inner peripheral wall surface 22*a* of the stator 22*a*.

The emulsification or dispersion can be performed more effectively by permitting the fluid or liquid being processed to be delivered (added) directly into the mixing section (mixer portion) in the above described way.

Figure 18:
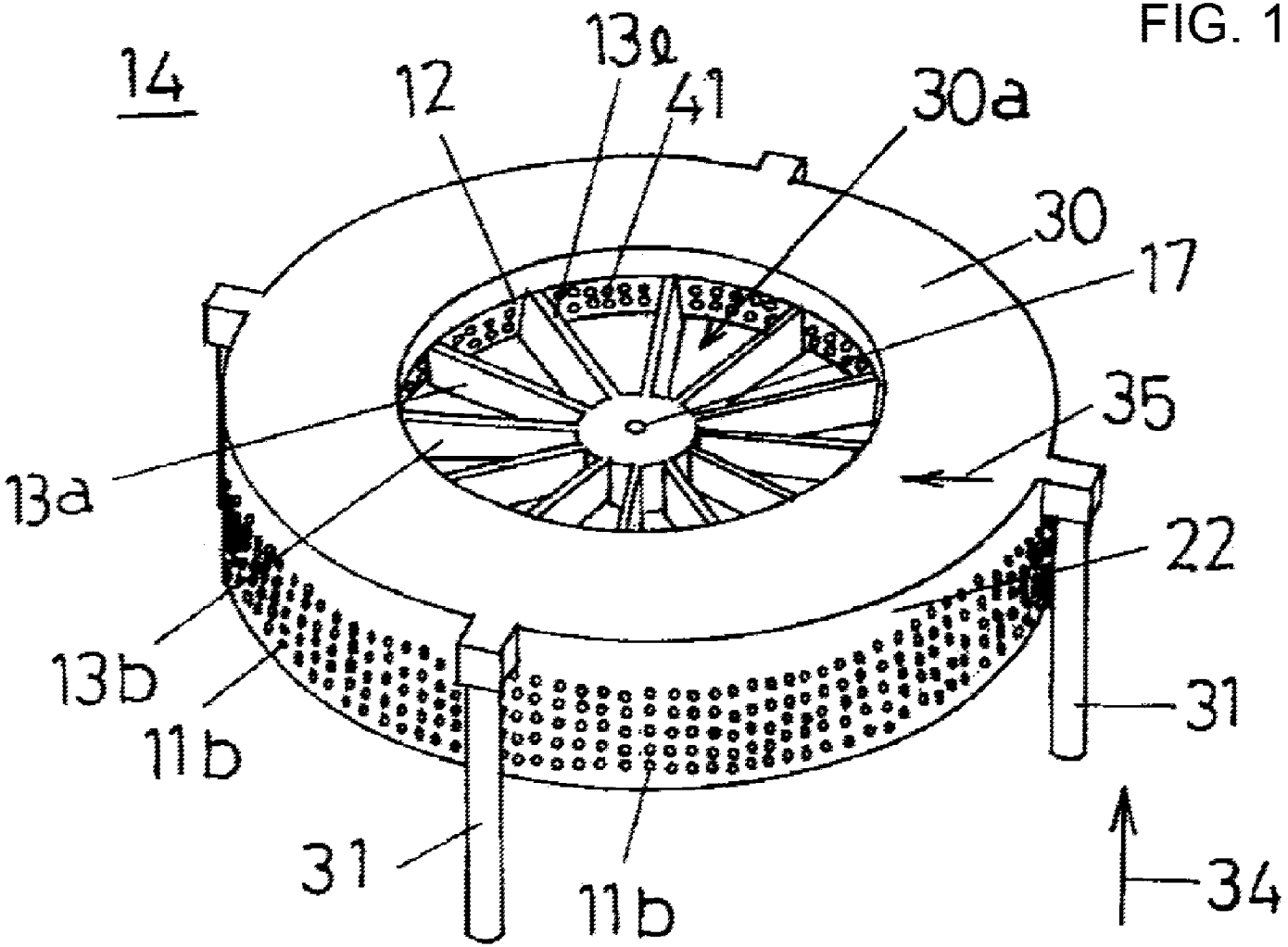
FIG. 18 is a perspective view of the mixer of the rotor-stator type in accordance with another embodiment of the present invention.
Figure 19:
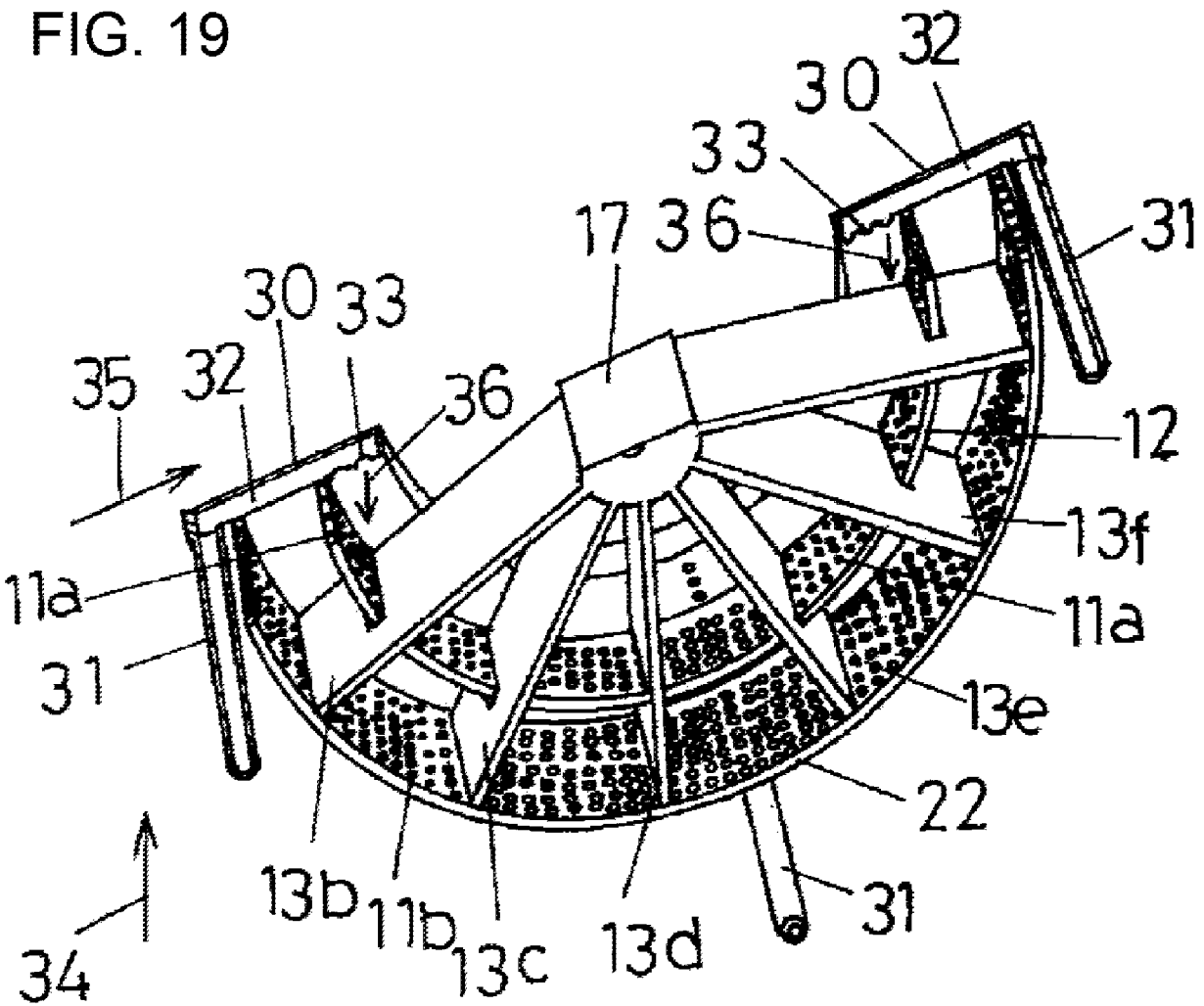
FIG. 19 is an exploded perspective view of the mixer as it is viewed obliquely and downwardly as shown in FIG. 15 although some parts are omitted.
Figure 20:
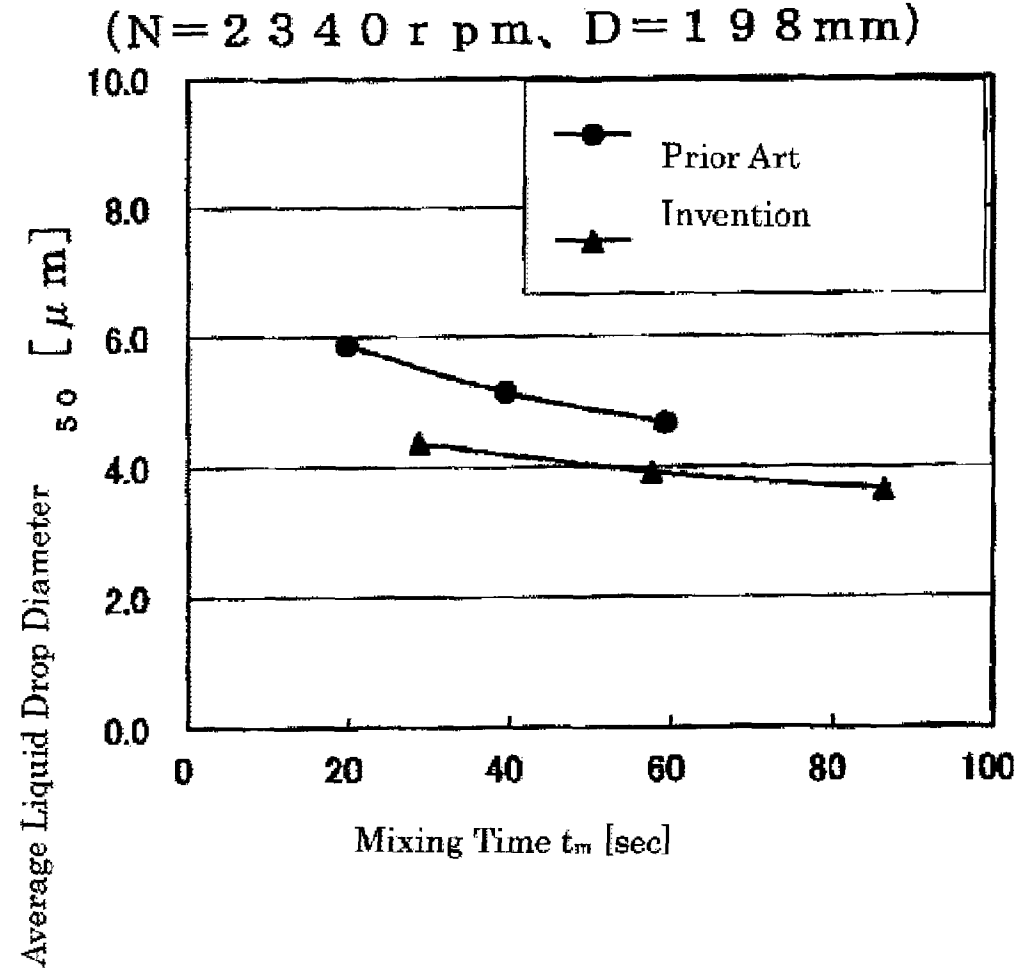
FIG. 20 illustrates the results obtained by the testing in which the mixer of the prior art and the mixer of the present invention were compared in order to represent the respective relationships between the mixing time and the resulting average liquid drop diameters.
Figure 21:
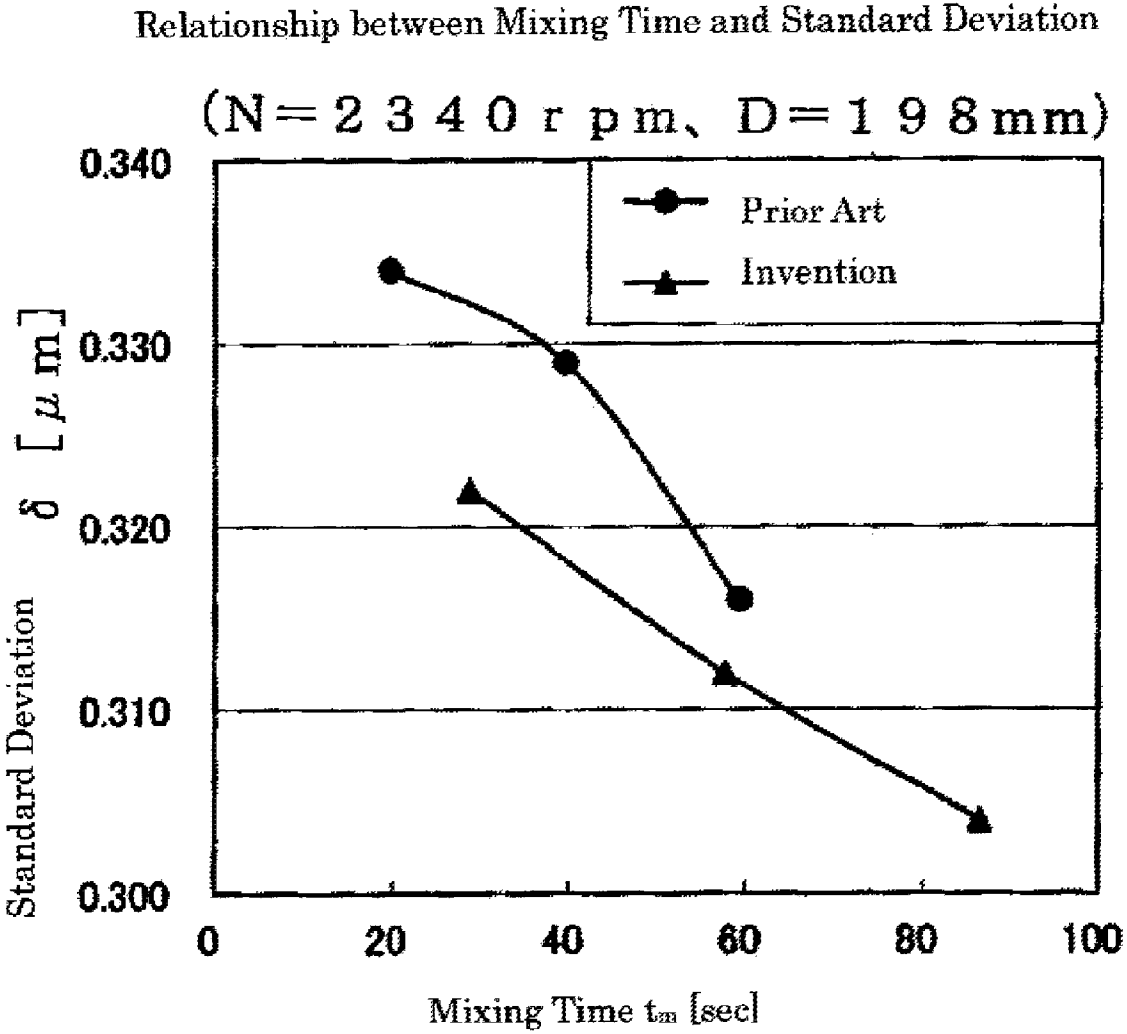
FIG. 21 illustrates the results obtained by the testing in which the mixer of the prior art and the mixer of the present invention were compared in order to represent the respective relationships between the mixing time and the standard deviation.
Figure 22:
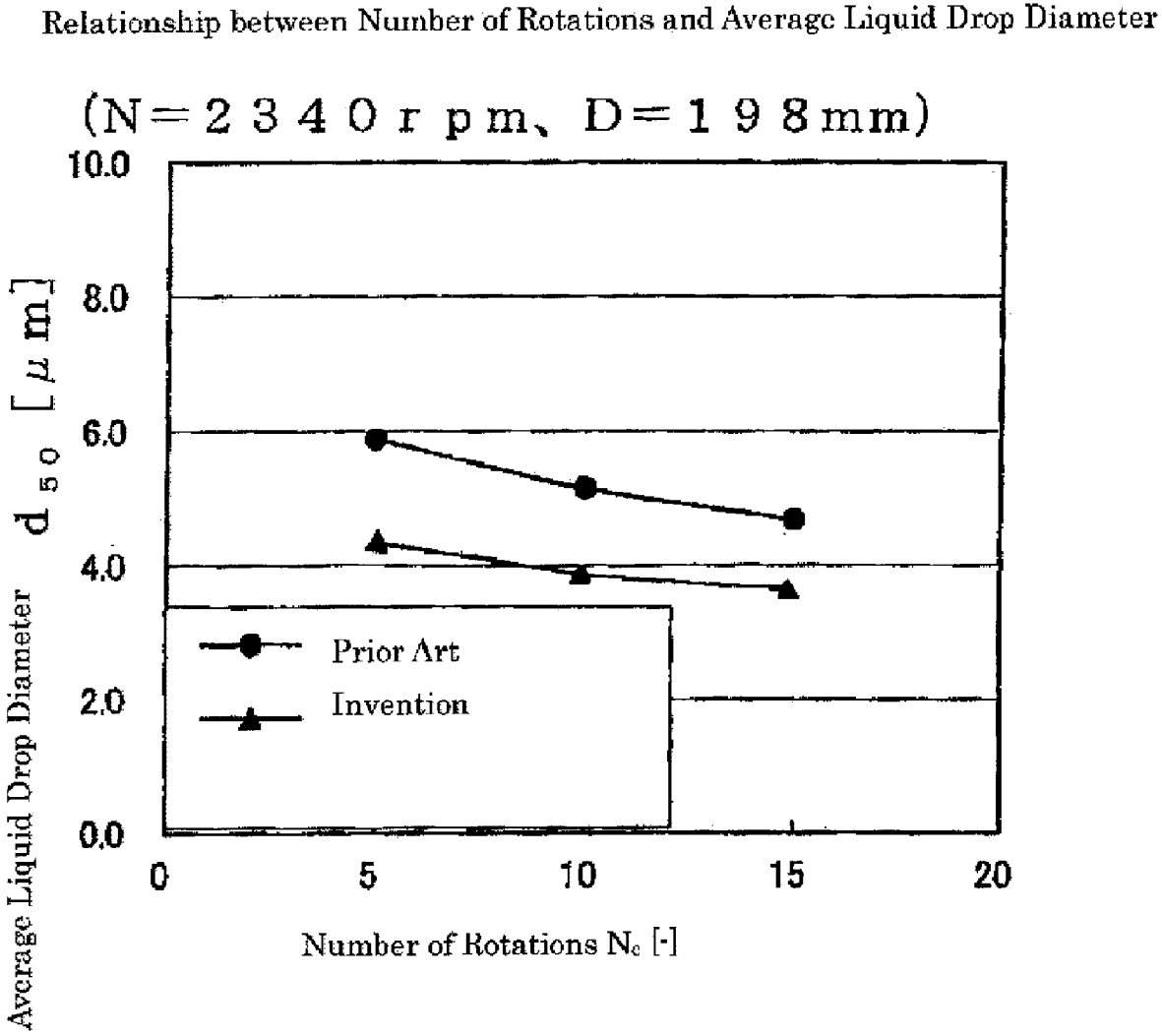
FIG. 22 illustrates the results obtained by the testing in which the mixer of the prior art and the mixer of the present invention were compared in order to represent the respective relationships between the rotor's number of rotations and the resulting average liquid drop diameters.
Figure 23:
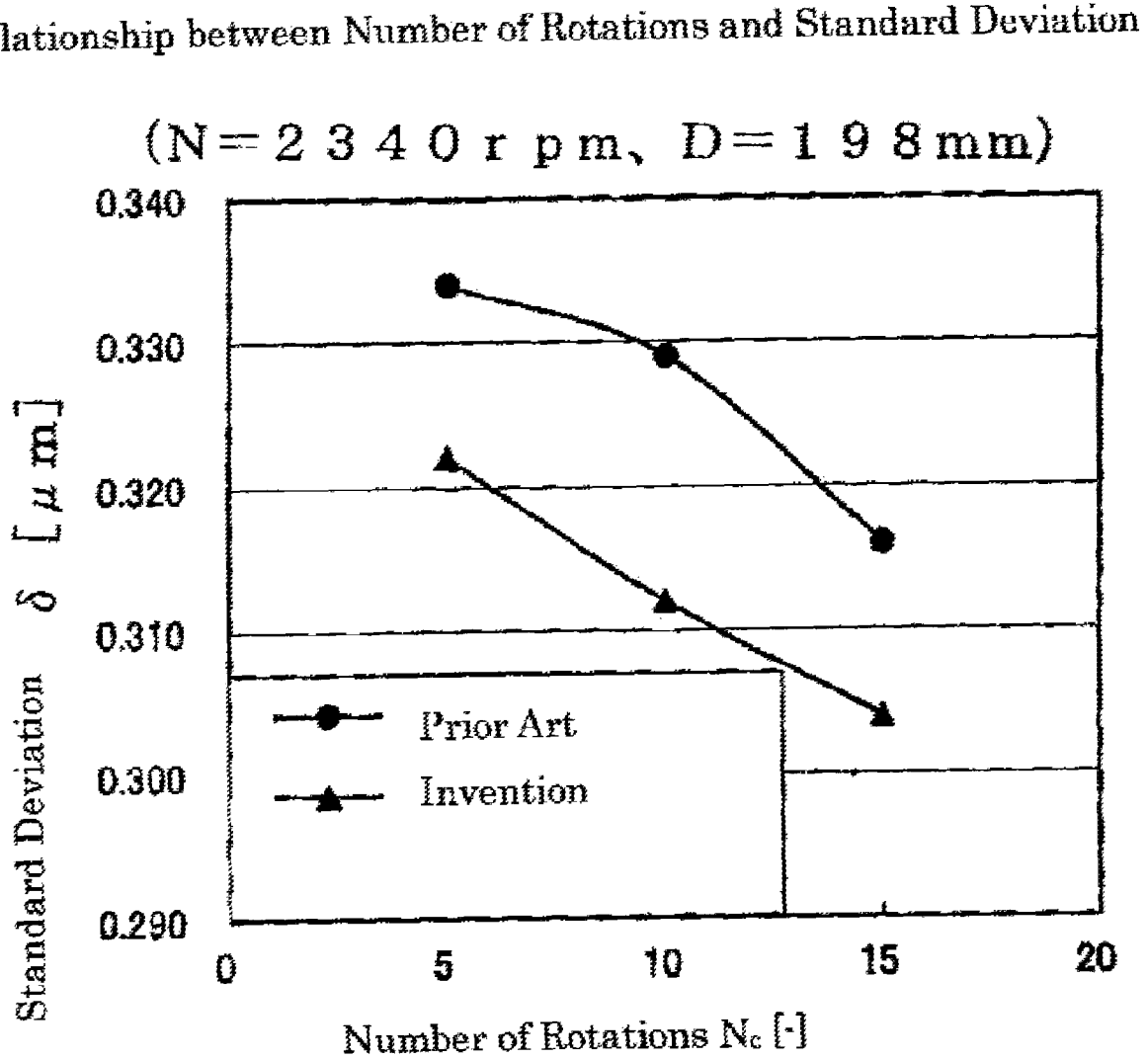
FIG. 23 illustrates the results obtained by the testing in which the mixer of the prior art and the mixer of the present invention were compared in order to represent the respective relationships between the rotor's number of rotations and the standard deviation.
Figure 24:
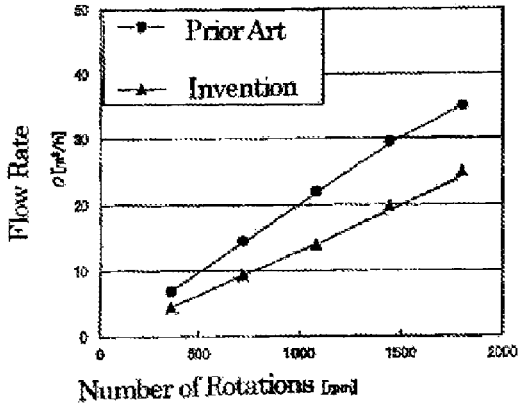
FIG. 24 illustrates the results obtained by the testing in which the mixer of the prior art and the mixer of the present invention were compared in order to represent (a) the respective relationships between the rotor's number of rotations and the flow rate, (b) the respective relationships between the rotor's number of rotations and the power and (c) the respective relationships between the rotor's number of rotations and the power contributing to the emulsification.
Figure 24:
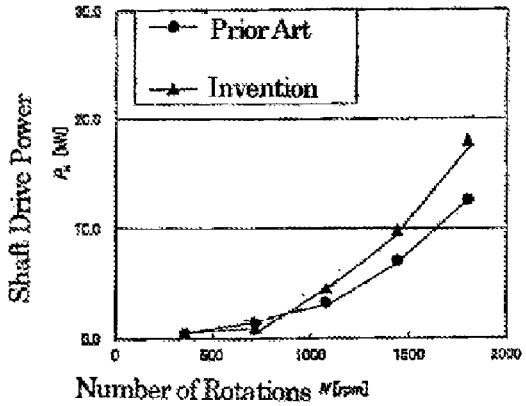
Figure 24:
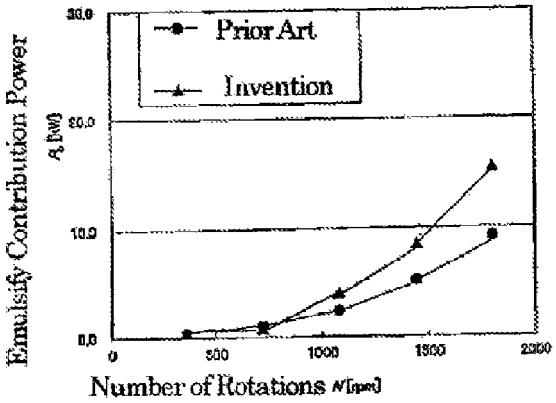

FIG. 18 and FIG. 19 represent another embodiment of the present invention. The embodiment shown in FIG. 18 and FIG. 19 differs from the previously described embodiment shown in FIGS. 15 through 17 in that the stators 12, 22 have an annular cover 30 extending radially inwardly from the upper end edge. Now, this difference is mainly described below.

It is noted that for the embodiment shown in FIG. 18 and FIG. 19, the stirring blade that extends radially from the rotary shaft 17 includes twelve (12) blades 13*a* to 13*l*.

In the current embodiment, the annular cover 30 is constructed such that it is attached to the upper end edge of the stator 22 and to the upper end edge of the stator 12.

In the embodiment shown in FIG. 18 and FIG. 19, the annular cover 30 that extends radially inwardly from the respective upper end edges of the stators 12 and 22 prevents the liquid being processed from being leaked toward the upper side as shown in FIG. 17 (*b*) through the gap between the stators 12, 22.

For the embodiment in which the annular cover 30 is provided, the mechanism that allows for the direct delivery (adding) as described in FIGS. 17 (*a*) and (*b*) may be replaced by making use of the annular cover 30.

There are inlet conduits 31 that are disposed on the outer circumference of the stator 22 so that each of the inlet conduits 31 extends toward the direction in which the rotary shaft 17 extends, and each of the inlet conduits 30 includes a conduit 32 that is communitively connected to the top end thereof and extends radially inwardly inside the annular cover 30. Each of the inlet conduit 30 has an inlet hole 33 formed on the part of the annular cover 30 located radially inwardly of the stator 12 having the smallest diameter among the plurality of stators 12, 22 and through which the liquid being processed can be introduced toward the bottom as shown in FIG. 17 (*b*). Each of the conduits 32 that extend radially inwardly inside the annular cover 30 is communicatively connected to the corresponding inlet hole 33. In this way, the liquid being processed can be introduced (added) through the inlet conduits 31, conduits 32 and inlet holes 33 as indicated by arrows 34, 35, 36.

The presence of the annular cover 30 can prevent the liquid being processed from being leaked through the gap between the rotor 13 and the stators 12, 22 and toward the top end in FIG. 17 (*b*), allowing the liquid being processed to pass through the openings 11*a*, 11*b* of the two stators 12, 22 and then to be guided from the radially inner side toward the outer side. In this way, the liquid being processed can pass through the mixing section that consists of three mixing stages each of which is formed between the outer peripheral surface 15*a* on the longitudinal groove 15 of each of the stirring blades 13*a*, etc and the inner peripheral wall face 12*a* of the stator 12, between the inner peripheral surface on the longitudinal groove 15 of each of the stirring blades 13*a*, etc and the outer peripheral wall face 12*b* of the stator 12, and between the wall face 16*a* on the radial outer end 16*b* of each of the stirring blades 13, etc and the inner peripheral wall face 22*a* of the stator 22 where the liquid being processed can be subjected to the high shear stress a total of three times.

Like the mixer in the embodiment shown in FIG. 15 through 17, the mixer in the embodiment of the present invention shown in FIG. 18 and FIG. 19 allows the gap between the stators 12, 22 and the rotor 13 to be adjusted and controlled accordingly while the rotor 13 is being rotated. Thus, the shear stress applied to the liquid being processed can be changed and adjusted accordingly, and the flow rate of the liquid being processed can also be changed and adjusted accordingly.

(Testing for Comparison and Examination)

For the testing purpose, the prior art mixer described in FIG. 1 and the mixer of the present invention described in FIG. 18 and FIG. 19 were compared. During this testing, the unit of the externally circulated mode was provided for use as shown in FIG. 3, and the liquid drop diameters on the middle way of the flow path were measured by using the linear diffraction type particle size analyzer (SALD-2000 offered by Shimazu Manufacturing Corporation), and the particle size breakup trend of the resulting liquid drop diameters was examined.

As used for the testing purpose, the diameter of the stator 2 included in the prior art mixer and the diameter of the stators 22 included in the mixer of the present invention are both 197 mm. The testing occurred by using the butter emulsified liquid having the composition ratio shown in Table 9 below.

| | Composition Ratio (%) | Composition Quantity (g) | FAT | SNF | TS |
|---|---|---|---|---|---|
| Butter | 5.99 | 2995 | 4.95 | 0.07 | 5.02 |
| Powdered Skim Milk | 5.16 | 2580 | 0.05 | 4.93 | 4.98 |
| Water | 88.85 | 44425 | | | |
| Total | 100 | 50000 | 5.00 | 5.00 | 10.00 |

The results obtained by the testing are presented in Tables 10 and 11, and in FIGS. 20 through 25. It may be appreciated from FIG. 20 that the particle size breakup trend provided by the mixer of the present invention is equivalent to that provided by the prior art mixer but can be achieved in the time as half as the prior art mixer. It may also be appreciated from FIG. 21 that the mixer of the present invention provides the liquid drop diameters that have less variations than the prior art mixer, and it may also be appreciated from FIG. 24 (*c*) that the mixer of the present invention provides the rotor's rotations that contribute to the emulsifying power as compared with the prior art mixer.

| | | | Particel Size (μm) | | | | Time |
|---|---|---|---|---|---|---|---|
| | | pass | Mean Particle Size | Standard Deviation | Median Diameter | Hole Diameter | [sec] |
| Butter Emulsion (1 hr) | Prior Art | 5 | 5.880 | 0.334 | 7.142 | 9.219 | 19.8 |
| | | 10 | 5.149 | 0.329 | 6.314 | 7.486 | 39.6 |
| | | 15 | 4.677 | 0.316 | 5.784 | 7.486 | 59.3 |
| | Invention | 5 | 4.370 | 0.322 | 5.218 | 7.486 | 28.8 |
| | | 10 | 3.921 | 0.312 | 4.533 | 6.078 | 57.7 |
| | | 15 | 3.657 | 0.304 | 4.114 | 6.078 | 86.5 |

Prior Art

| Frequency [Hz] | Number of rotations [rpm] | Flow rate [$m^3$/h] | Current Value [A] | Torque [N · m] | Shaft Drive Power [kW] | Pump Power [kW] | Density Contribution Power [kW] | Notes |
|---|---|---|---|---|---|---|---|---|
| 10 | 360 | 7 | 5.04 | 12 | 0.5 | 0.0 | 0.4 | |
| 20 | 720 | 14.6 | 6.01 | 18 | 1.4 | 0.2 | 1.2 | |
| 30 | 1080 | 22 | 8.1 | 29 | 3.3 | 0.8 | 2.5 | |
| 40 | 1440 | 29.5 | 11.6 | 47 | 7.1 | 1.8 | 5.3 | |
| 50 | 1800 | 35 | 16.6 | 67 | 12.6 | 3.4 | 9.2 | 10 min Temperature rising 1.8° C. |
| 65 | 2340 | 45.5 | | | | | | |

pass[sec/pass]

| 1 | 5 | 10 | 15 |
|---|---|---|---|
| 4.0 | 19.8 | 39.6 | 59.3 |

-continued

| Invention | | | | | | | | |
|---|---|---|---|---|---|---|---|---|
| Frequency [Hz] | Number of rotations [rpm] | Flow rate [$m^3$/h] | Current Value [A] | Torque [N · m] | Shaft Drive Power [kW] | Pump Power [kW] | Density Contribution Power [kW] | Notes |
| 10 | 360 | 4.5 | 5.3 | 13 | 0.5 | 0.0 | 0.5 | |
| 20 | 720 | 9.5 | 6.9 | 12 | 0.9 | 0.1 | 0.8 | |
| 30 | 1080 | 14 | 10.4 | 41 | 4.6 | 0.5 | 4.1 | |
| 40 | 1440 | 19.8 | 15.8 | 65 | 9.8 | 1.2 | 8.6 | |
| 50 | 1800 | 25 | 22.8 | 95 | 17.9 | 2.4 | 15.5 | 10 min Temperature rising 3.2° C. |
| 65 | 2340 | 32.5 | | | | | | |

| pass[sec/pass] | | | |
|---|---|---|---|
| 1 | 5 | 10 | 15 |
| 5.5 | 27.7 | 55.4 | 83.1 |

Figure 25:
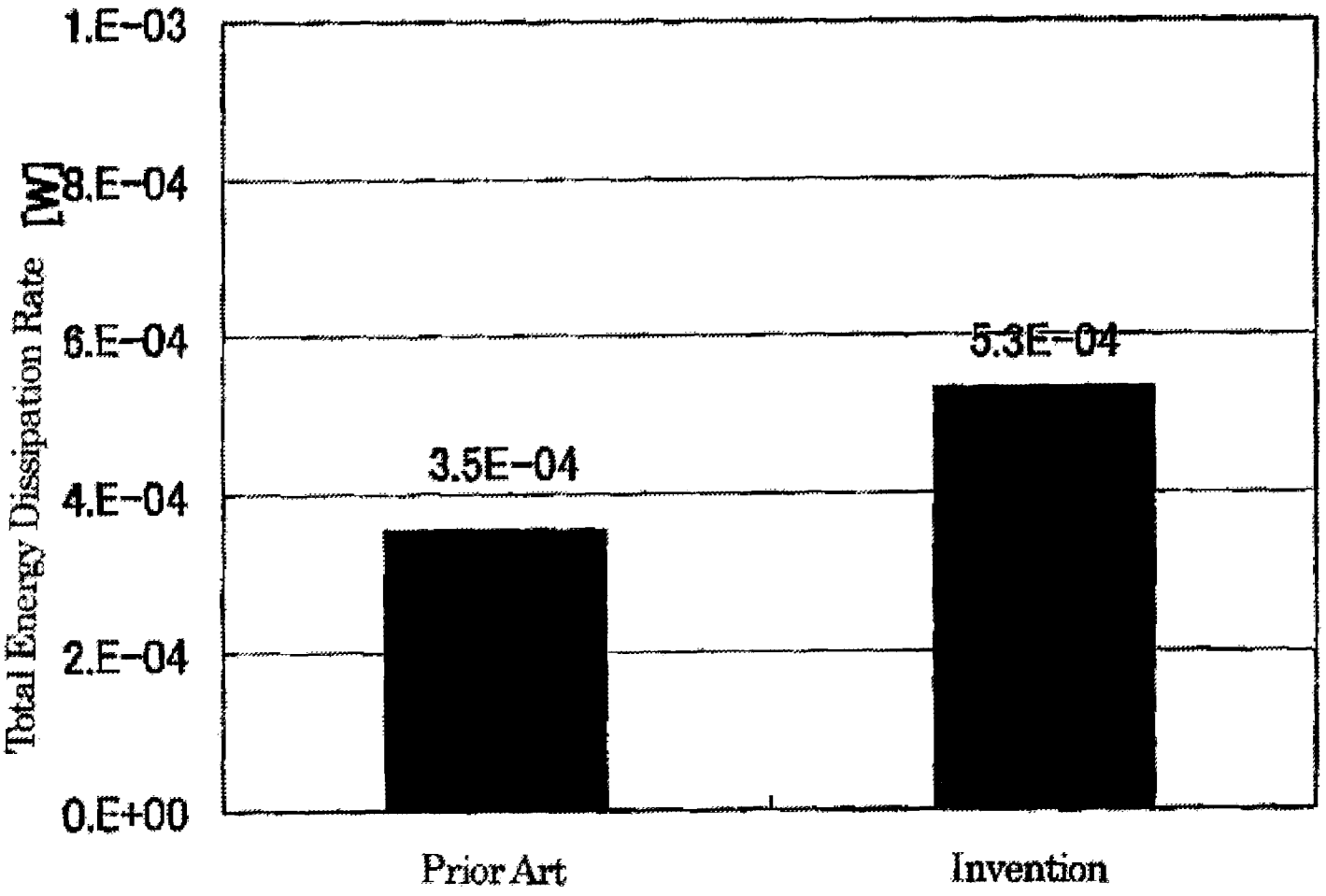
FIG. 25 presents the estimation results obtained by analyzing the energy dissipation rate numerically for the mixer of the present invention versus the mixer of the prior art.

FIG. 25 represents the estimated results obtained by analyzing the energy dissipation rate numerically. It may be appreciated from the estimated results in FIG. 26 that the mixer of the present invention provides the higher energy dissipation that is equal to as two times as the prior art mixer. More specifically, the mixer of the present invention has the capability that is equal to as two times as the prior art mixer. It may then be estimated from the above that the mixer of the present invention provides the particle size breakup effect that can be achieved in the time as half as the prior art mixer. It may be appreciated from FIG. 20 that the actual particle size breakup trend provided by the mixer of the present invention is the same as the results obtained by analyzing the trend numerically.

As the present invention provides the excellent effects and functionalities that will be described below, functions, it can be utilized in the various industrial fields in which the emulsification, dispersion and particle size breakup processes occur. For example, the present invention may be utilized in the manufacturing fields, such as for manufacturing the foods, pharmaceutical medicines, chemical products and the like.

(1) The high performance mixer of the rotor-stator-type provided by the present invention can provide the higher particle size breakup or emulsification effect and allows the higher quality products to be manufactured than the conventional typical high performance (high shearing type) mixer of the rotor-stator type.

(2) The mixer of the rotor-stator type according to the present invention allows the products having the quality that is equivalent to or higher than the conventional mixer of the same type to be manufactured at less time than the conventional mixer.

(3) In accordance with the present invention, the scale up or scale down can be performed for the various mixers of the rotor-stator type ranging from the small size mixers to the large size mixers by considering the processing (manufacturing) time for those mixers.

(4) The particle size breakup effect (the resulting drop diameter) that meets the needs of each individual user can be provided, and the processing (agitating) time that is required for this purpose can be estimated. Thus, it is sufficient that the mixer is to be run (or process) for as small time as required for the above estimated time. The running time of the mixer of the rotor-stator type can be reduced accordingly, and the energy required for this purpose can be saved.

What is claimed is:

1. A mixer comprising a mixer unit that includes a stator having a plurality of openings and a rotor disposed on an inner side of the stator and spaced by a first gap away from the stator, wherein said rotor has a rotary shaft and a plurality of agitating blades extending radially from a center of rotation of the rotor;

said stator includes a plurality of stator components each having a different peripheral diameter;

said rotor is disposed in such a manner that it is spaced by the first gap away from said plurality of stator components;

a second gap is formed between a wall surface on a radially outermost end of each of the agitating blades and an inner peripheral wall surface of the stator; and said stator components and said rotor are configured such that the first gap between the stator components and the rotor can be changed while the rotor is being rotated so that the stator components and the rotor can be brought closer to or farther away from each other in the direction in which the rotary shaft of said rotor extends;

wherein the mixer is so designed by using Equation 1 below to estimate the running time of said mixer and the resulting liquid drop diameters of the fluid being processed that can be obtained during the mixer's running time that the liquid drop diameters of the fluid being processed can be obtained during the particular mixer running time when said mixer is used to subject the fluid being processed to the emulsification, dispersion, particle size breakup or any other mixing processing:

$$\varepsilon_a = \varepsilon_g + \varepsilon_s \qquad \text{Equation 1}$$

$$= [(N_p - N_{qd}\pi^2)\cdot n_r]\left\{D^3\left[\left(\frac{D^3 b}{\delta(D+\delta)}\right) + \frac{\pi^2 n_s^2 d^3 (d+4\ell)}{4N_{qd}[n_s\cdot d^2 + 4\delta(D+\delta)]}\right]\right\}\left(\frac{N^4\cdot t_m}{V}\right)$$

$$= [(N_p - N_{qd}\pi^2)\cdot n_r]\cdot[D^3(K_g + K_s)]\cdot\left(\frac{N^4\cdot t_m}{V}\right)$$

$$= K_c\cdot\left(\frac{N^4\cdot t_m}{V}\right)$$

In the Equation 1, $\epsilon_a$: Total energy dissipation rate ($m^2/s^3$)

$\epsilon_g$: Local shear stress in the gap between the rotor and stator ($m^2/s^3$)

$\epsilon_s$: Local energy dissipation rate in the stator ($m^2/s^3$)

$N_p$: Number of powers (-)

Nqd: Number of flow rates (-)

$n_r$: Number of rotor blades (-)

D: Diameter of rotor (m)

b: Thickness of rotor blade tip (m)

δ: Gap between rotor and stator (m)

$n_s$: Number of stator holes (-)

d: Diameter of stator hole (m)

l: Thickness of stator (m)

N: Number of rotations (1/s)

$t_m$: Mixing time (s)

V: Flow rate ($m^3$)

$K_g$: Configuration dependent term ($m^2$)

$K_s$ Configuration dependent term in stator ($m^2$)

$K_c$: Configuration dependent term for the entire mixer;

wherein liquid being processed is introduced into a portion between said stator components and said rotor which is located on the inner side of each of said stator components and is spaced by the first gap away from each of said stator components.

2. The mixer as defined in claim 1, wherein liquid being processed is introduced into a portion between said stator components and said rotor which is located on the inner side of each of said stator components and is spaced by the first gap away from each of said stator components.

3. The mixer as defined in claim 1, wherein said stator components have an annular cover that extends inwardly from an upper end edge thereof.

4. The mixer as defined in claim 3, wherein said annular cover that is located on the radial inner side of the stator component that has the smallest diameter among said plurality of stator components has an inlet hole through which a fluid being processed is introduced downwardly.

5. The mixer as defined in claim 1, wherein the openings provided on each of said stator components have a round shape.

6. The mixer as defined in claim 1, wherein the openings on said plurality of stator components are provided around the peripheral wall of each of said stator components, and represent more than 20% of the total opening area.

7. The mixer as defined in claim 1, wherein the mixer can be scaled up or scaled down by calculating the Equation 1 to estimate the particular mixer running time and the resulting liquid drop diameters for the fluid being processed thus obtained during the particular mixer running time $$\begin{aligned}\varepsilon_a &= \varepsilon_g + \varepsilon_s \qquad \text{Equation 1}\\ &= [(N_p - N_{qd}\pi^2)\cdot n_r]\\ &\quad \left\{D^3\left[\left(\frac{D^3 b}{\delta(D+\delta)}\right) + \frac{\pi^2 n_s^2 d^3 (d+4\ell)}{4N_{qd}[n_s\cdot d^2 + 4\delta(D+\delta)]}\right]\right\}\left(\frac{N^4\cdot t_m}{V}\right)\\ &= [(N_p - N_{qd}\pi^2)\cdot n_r]\cdot[D^3(K_g+K_s)]\cdot\left(\frac{N^4\cdot t_m}{V}\right)\\ &= K_c\cdot\left(\frac{N^4\cdot t_m}{V}\right).\end{aligned}$$

8. A method for manufacturing foods, pharmaceutical medicines or chemical products by using a mixer comprising a mixer unit that includes a stator having a plurality of openings and a rotor disposed on an inner side of the stator and spaced by a first gap away from the stator, wherein said rotor has a rotary shaft and a plurality of agitating blades extending radially from a center of rotation of the rotor;

said stator includes a plurality of stator components each having a different peripheral diameter;

said rotor is disposed in such a manner that it is spaced by the first gap away from said plurality of stator components;

a second gap is formed between a wall surface on a radially outermost end of each of the agitating blades and an inner peripheral wall surface of the stator; and said stator components and said rotor are configured such that the first gap between the stator components and the rotor can be changed while the rotor is being rotated so that the stator components and the rotor can be brought closer to or farther away from each other in the direction in which the rotary shaft of said rotor extends;

wherein the method comprises subjecting the fluid being processed to an emulsification, dispersion, particle size breakup or mixing operation, wherein the foods, pharmaceutical medicines or chemical products are manufactured by calculating the Equation 1 listed below to estimate the mixer's running time and resulting liquid drop diameters obtained during the mixer's running time:

$$\begin{aligned}\varepsilon_a &= \varepsilon_g + \varepsilon_s \qquad \text{Equation 1}\\ &= [(N_p - N_{qd}\pi^2)\cdot n_r]\\ &\quad \left\{D^3\left[\left(\frac{D^3 b}{\delta(D+\delta)}\right) + \frac{\pi^2 n_s^2 d^3 (d+4\ell)}{4N_{qd}[n_s\cdot d^2 + 4\delta(D+\delta)]}\right]\right\}\left(\frac{N^4\cdot t_m}{V}\right)\\ &= [(N_p - N_{qd}\pi^2)\cdot n_r]\cdot[D^3(K_g+K_s)]\cdot\left(\frac{N^4\cdot t_m}{V}\right)\\ &= K_c\cdot\left(\frac{N^4\cdot t_m}{V}\right)\end{aligned}$$

In the Equation 1, $\epsilon_a$: Total energy dissipation rate ($m^2/s^3$)

$\epsilon_g$: Local shear stress in the gap between the rotor and stator ($m^2/s^3$)

$\epsilon_s$: Local energy dissipation rate in the stator ($m^2/s^3$)

$N_p$: Number of powers (-)

Nqd: Number of flow rates (-)

$n_r$: Number of rotor blades (-)

D: Diameter of rotor (m)

b: Thickness of rotor blade tip (m)

δ: Gap between rotor and stator (m)

$n_s$: Number of stator holes (-)

d: Diameter of stator hole (m)

l: Thickness of stator (m)

N: Number of rotations (I/s)

$t_m$: Mixing time (s)

V: Flow rate ($m^3$)

$K_g$: Configuration dependent term ($m^2$)

$K_s$ Configuration dependent term in stator ($m^2$)

$K_c$: Configuration dependent term for the entire mixer.

9. A mixer comprising a mixer unit that includes a stator having a plurality of openings and a rotor disposed on an inner side of the stator and spaced by a first gap away from the stator, wherein said rotor has a rotary shaft and a plurality of agitating blades extending radially from a center of rotation of the rotor;

said stator includes a plurality of stator components each having a different peripheral diameter;

said rotor is disposed in such a manner that it is spaced by the first gap away from said plurality of stator components;

a second gap is formed between a wall surface on a radially outermost end of each of the agitating blades and an inner peripheral wall surface of the stator; and said stator components and said rotor are configured such that the first gap between the stator components and the rotor can be changed while the rotor is being rotated so that the stator components and the rotor can be brought closer to or farther away from each other in the direction in which the rotary shaft of said rotor extends;

wherein the mixer can be scaled up or scaled down by calculating the Equation 1 to estimate the particular mixer running time and the resulting liquid drop diameters for the fluid being processed thus obtained during the particular mixer running time:

$$\begin{aligned}\varepsilon_a &= \varepsilon_g + \varepsilon_s \qquad \text{Equation 1}\\ &= [(N_p - N_{qd}\pi^2)\cdot n_r]\\ &\quad \left\{D^3\left[\left(\frac{D^3 b}{\delta(D+\delta)}\right) + \frac{\pi^2 n_s^2 d^3(d+4\ell)}{4N_{qd}[n_s\cdot d^2 + 4\delta(D+\delta)]}\right]\right\}\left(\frac{N^4\cdot t_m}{V}\right)\\ &= [(N_p - N_{qd}\pi^2)\cdot n_r]\cdot[D^3(K_g + K_s)]\cdot\left(\frac{N^4\cdot t_m}{V}\right)\\ &= K_c\cdot\left(\frac{N^4\cdot t_m}{V}\right)\end{aligned}$$

In the Equation 1, $\epsilon_a$: Total energy dissipation rate ($m^2/s^3$)

$\epsilon_g$: Local shear stress in the gap between the rotor and stator ($m^2/s^3$)

$\epsilon_s$: Local energy dissipation rate in the stator ($m^2/s^3$)

$N_p$: Number of powers (-)

Nqd: Number of flow rates (-)

$n_r$: Number of rotor blades (-)

D: Diameter of rotor (m)

b: Thickness of rotor blade tip (m)

δ: Gap between rotor and stator (m)

$n_s$: Number of stator holes (-)

d: Diameter of stator hole (m)

l: Thickness of stator (m)

N: Number of rotations (I/s)

$t_m$: Mixing time (s)

V: Flow rate ($m^3$)

$K_g$: Configuration dependent term ($m^2$)

$K_s$ Configuration dependent term in stator ($m^2$)

$K_c$: Configuration dependent term for the entire mixer.

10. The mixer as defined in claim 9, wherein liquid being processed is introduced into a portion between said stator components and said rotor which is located on the inner side of each of said stator components and is spaced by the first gap away from each of said stator components.

11. The mixer as defined in claim 9, wherein said stator components have an annular cover that extends inwardly from an upper end edge thereof.

12. The mixer as defined in claim 11, wherein said annular cover that is located on the radial inner side of the stator component that has the smallest diameter among said plurality of stator components has an inlet hole through which a fluid being processed is introduced downwardly.

13. The mixer as defined in claim 9, wherein the openings provided on each of said stator components have a round shape.

14. The mixer as defined in claim 9, wherein the openings on said plurality of stator components are provided around the peripheral wall of each of said stator components, and represent more than 20% of the total opening area.

* * * * *